US010034588B2

(12) United States Patent
Kasper et al.

(10) Patent No.: US 10,034,588 B2
(45) Date of Patent: Jul. 31, 2018

(54) BRUSHROLL FOR VACUUM CLEANER

(71) Applicant: BISSELL Homecare, Inc., Grand Rapids, MI (US)

(72) Inventors: Gary A. Kasper, Grand Rapids, MI (US); Michael D. Graham, Lake Odessa, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 152 days.

(21) Appl. No.: 15/249,529

(22) Filed: Aug. 29, 2016

(65) Prior Publication Data

US 2016/0367096 A1 Dec. 22, 2016

Related U.S. Application Data

(62) Division of application No. 14/208,381, filed on Mar. 13, 2014, now Pat. No. 9,693,663.

(60) Provisional application No. 61/793,471, filed on Mar. 15, 2013.

(51) Int. Cl.

| | |
|---|---|
| ***A47L 9/04*** | (2006.01) |
| ***A46D 1/08*** | (2006.01) |
| ***A46B 3/16*** | (2006.01) |
| ***A46D 3/04*** | (2006.01) |
| ***A47L 5/26*** | (2006.01) |
| ***A47L 9/16*** | (2006.01) |
| *A46B 9/12* | (2006.01) |
| *A46B 13/00* | (2006.01) |

(52) U.S. Cl.

CPC ..... *A47L 9/0477* (2013.01); *A46B 3/16* (2013.01); *A46D 1/08* (2013.01); *A46D 3/042* (2013.01); *A47L 5/26* (2013.01); *A47L 9/1616* (2013.01); *A47L 9/1683* (2013.01); *A46B 9/12* (2013.01); *A46B 13/006* (2013.01)

(58) Field of Classification Search

CPC ..... A47L 9/0477; A47L 9/1616; A47L 5/26; A47L 9/1683; A47L 9/04; A46D 3/042; A46D 3/16; A46D 1/08; A46D 13/006; A46D 9/12

See application file for complete search history.

(56) References Cited

U.S. PATENT DOCUMENTS

| | | | |
|---|---|---|---|
| 1,919,011 | A | 7/1933 | Connor |
| 1,942,497 | A | 1/1934 | Smellie |
| 2,459,007 | A | 1/1949 | Taylor |
| 2,476,537 | A | 7/1949 | Erickson |
| 2,659,921 | A | 11/1953 | Osborn |
| 3,597,787 | A | 8/1971 | Rosendall |
| 3,597,789 | A | 8/1971 | Boyd |
| 3,716,889 | A | 2/1973 | Goldstein |
| 3,820,186 | A | 6/1974 | Peabody |
| 4,042,997 | A | 8/1977 | McDowell et al. |
| 4,173,807 | A | 11/1979 | Maier |

(Continued)

FOREIGN PATENT DOCUMENTS

| | | |
|---|---|---|
| GB | 411753 | 6/1934 |
| GB | 491495 | 9/1938 |

(Continued)

*Primary Examiner* — David Redding

(74) *Attorney, Agent, or Firm* — McGarry Bair PC

(57) ABSTRACT

A brushroll dowel for a vacuum cleaner having bristle stiffeners protruding from a brush dowel. The brushroll can be made using an injection molding process, with the bristle stiffeners integrally molded with the brush dowel and a plurality of stiffened bristles protruding from the brush dowel adjacent to the bristle stiffeners.

20 Claims, 25 Drawing Sheets

(56) References Cited

U.S. PATENT DOCUMENTS

| | | | |
|---|---|---|---|
| 4,177,536 | A | 12/1979 | Powers |
| 4,307,479 | A | 12/1981 | Mertes et al. |
| 4,349,936 | A | 9/1982 | Lorson et al. |
| 4,372,004 | A | 2/1983 | Vermillion |
| 4,912,805 | A | 4/1990 | Krasznai et al. |
| 4,955,102 | A | 9/1990 | Cousins |
| 5,061,106 | A | 10/1991 | Kent |
| 5,272,785 | A | 12/1993 | Stegens |
| 5,435,038 | A | 7/1995 | Sauers |
| 5,452,490 | A | 9/1995 | Brundula et al. |
| 5,495,634 | A | 3/1996 | Brundula et al. |
| 5,687,446 | A | 11/1997 | Chen et al. |
| 6,108,853 | A | 8/2000 | Dittus |
| 6,530,106 | B1 | 3/2003 | Brundula |
| 6,539,575 | B1 | 4/2003 | Cohen |
| 6,574,823 | B1 | 6/2003 | Stegens |
| 6,591,441 | B2 | 7/2003 | Stegens et al. |
| 6,760,952 | B1 | 7/2004 | Stegens |
| 2005/0039282 | A1 | 2/2005 | Paterson et al. |
| 2006/0053584 | A1 | 3/2006 | Dever |
| 2006/0090291 | A1 | 5/2006 | Dever |
| 2006/0117521 | A1 | 6/2006 | Dever |
| 2006/0272122 | A1 | 12/2006 | Butler et al. |
| 2008/0104785 | A1 | 5/2008 | Robinson |
| 2009/0165241 | A1 | 7/2009 | Han et al. |
| 2010/0107359 | A1 | 5/2010 | Yoo |
| 2010/0306957 | A1 | 12/2010 | Follows et al. |
| 2012/0017936 | A1 | 1/2012 | Dant et al. |

FOREIGN PATENT DOCUMENTS

| | | | |
|---|---|---|---|
| GB | 584478 | | 1/1947 |
| GB | 2409405 | B | 12/2005 |
| KR | 1020100088360 | A | 8/2010 |

BRUSHROLL FOR VACUUM CLEANER

CROSS-REFERENCE TO RELATED APPLICATION

This application is a division of U.S. patent application Ser. No. 14/208,381, filed Mar. 13, 2014, now U.S. Pat. No. 9,693,663 which claims the benefit of U.S. Provisional Application No. 61/793,471, filed Mar. 15, 2013, both of which are incorporated herein by reference in their entirety.

BACKGROUND

Vacuum cleaners can include an agitator for agitating debris on a surface to be cleaned so that the debris is more easily ingested into the vacuum cleaner. In some cases, the agitator comprises a motor-driven brushroll that rotates within a base or floor nozzle. Brushrolls typically have a generally cylindrical dowel with multiple bristle tufts extending radially from the dowel.

BRIEF SUMMARY

According to one aspect of the invention, a brushroll for a vacuum cleaner comprises an injection-molded brush dowel having a central rotational axis defining an origin for a first axis extending through the dowel and a second axis extending through the dowel perpendicularly to the first axis to conceptually divide the dowel into quadrants, two bristle stiffeners integrally molded with the dowel and lying in opposing quadrants, each having a parting line which is radially spaced from and non-parallel to the rotational axis, and a plurality of stiffened bristles protruding from the brush dowel adjacent to the bristle stiffeners, wherein the first axis defines a line of draw for a two-piece mold forming the brush dowel and bristle stiffeners.

DETAILED DESCRIPTION

The invention relates to vacuum cleaners and in particular to vacuum cleaners having a motor-driven brushroll. For purposes of description related to the figures, the terms "upper," "lower," "right," "left," "rear," "front," "vertical," "horizontal," and derivatives thereof shall relate to the invention as oriented in FIG. 1 from the perspective of a user behind the vacuum cleaner, which defines the rear of the vacuum cleaner. However, it is to be understood that the invention may assume various alternative orientations, except where expressly specified to the contrary.

Figure 1:
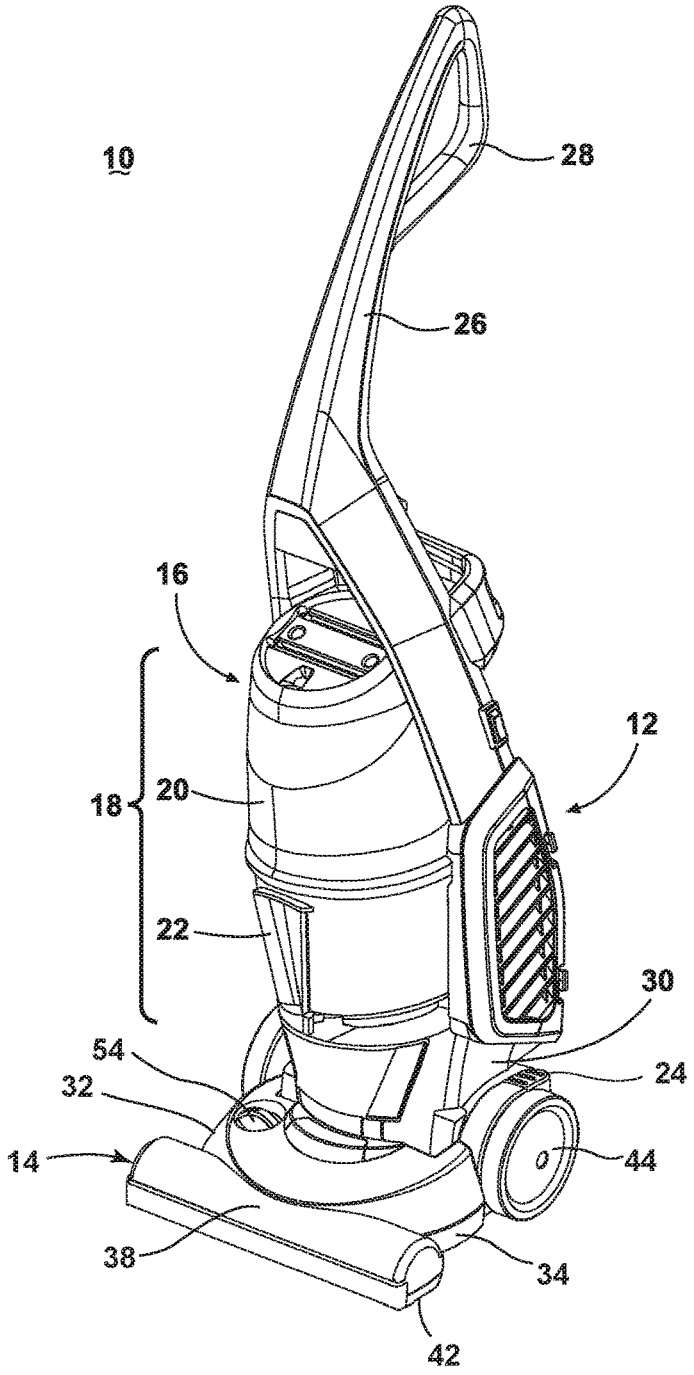
FIG. 1 is a perspective view of a vacuum cleaner.

FIG. 1 is a perspective view of the vacuum cleaner 10 in the form of an upright vacuum cleaner. While shown and referred to herein as an upright vacuum cleaner, the vacuum cleaner 10 can alternatively be configured as a hand-held vacuum cleaning device, or as an apparatus having a floor nozzle or a hand-held accessory tool connected to a canister or other portable device by a vacuum hose. Additionally, the vacuum cleaner 10 can be configured to have fluid distribution capability and/or extraction capability.

As illustrated, the vacuum cleaner 10 comprises an upper housing 12 pivotally mounted to a lower base 14. The upper housing 12 generally comprises a main support section 16 supporting a collection system 18 for separating and collecting contaminants from a working airstream for later disposal. In one conventional arrangement illustrated herein, the collection system 18 can include a cyclone separator 20 for separating contaminants from a working airstream and a removable dirt cup 22 for receiving and collecting the separated contaminants from the cyclone separator 20. The cyclone separator 20 can have a single cyclonic separation stage, or multiple stages. In another conventional arrangement, the collection system 18 can include an integrally formed cyclone separator and dirt cup, with the dirt cup being provided with a bottom-opening dirt door for contaminant disposal. It is understood that other types of collection systems 18 can be used, such as centrifugal separators or bulk separators. In yet another conventional arrangement, the collection system 18 can include a filter bag. The vacuum cleaner 10 can also be provided with one or more additional filters upstream or downstream of the collection system 18.

The upper housing 12 is pivotally mounted to the base 14 for movement between an upright storage position, shown in FIG. 1, and a reclined use position (not shown). The vacuum cleaner 10 can be provided with a detent mechanism, such as a pedal 24 pivotally mounted to the base 14, for selectively releasing the upper housing 12 from the storage position to the use position. The details of such a detent pedal 24 are known in the art, and will not be discussed in further detail herein.

The upper housing 12 also has an elongated handle 26 extending upwardly from the main support section 16 that is provided with a hand grip 28 at one end that can be used for maneuvering the vacuum cleaner 10 over a surface to be cleaned. A motor cavity 30 is formed at a lower end of the support section 16 and contains a conventional suction source such as a motor/fan assembly 36 (FIG. 2) positioned therein in fluid communication with the collection system 18. The vacuum cleaner 10 can also be provided with one or more additional filters upstream or downstream of motor/fan assembly.

Figure 2:
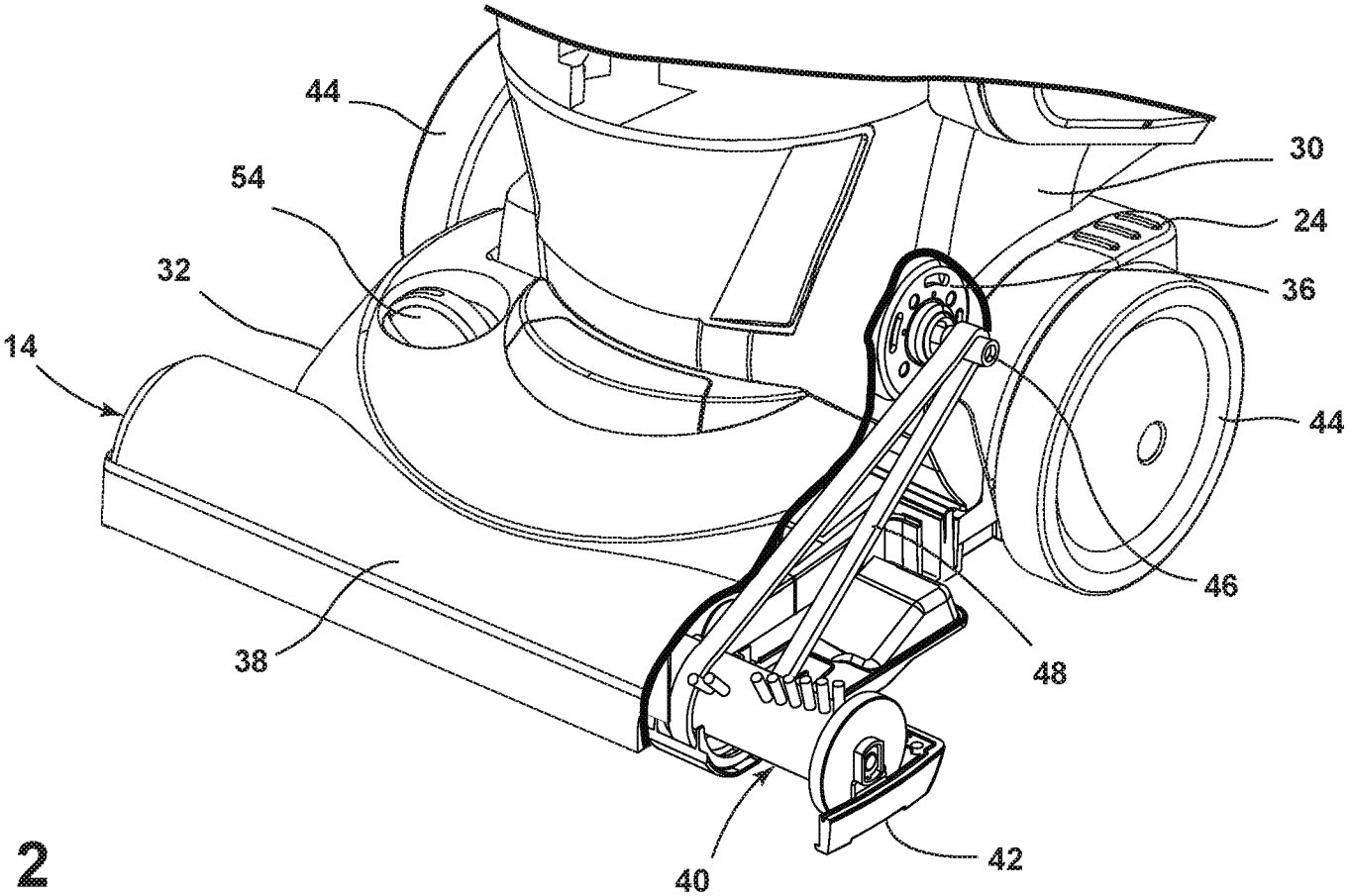
FIG. 2 is a perspective view of a lower portion of the vacuum cleaner from FIG. 1, with portions cut away for clarity.

FIG. 2 is a view of a lower portion of the vacuum cleaner 10 from FIG. 1, with portions cut away to show features of the base 14. The base 14 can include an upper housing 32 that couples with a lower housing 34 to create a partially enclosed space therebetween. An agitator chamber 38 can be provided at a forward portion of the lower housing 34 for receiving a brushroll 40. A suction nozzle opening 42 is formed in the lower housing 34 and is in fluid communication with the agitator chamber 38 and the collection system 18 (FIG. 1). Wheels 44 can be provided on the base 14 for maneuvering the vacuum cleaner 10 over a surface to be cleaned.

The brushroll 40 is positioned within the agitator chamber 38 for rotational movement about an axis X. A single brushroll 40 is illustrated; however, it is within the scope of the invention for dual rotating brushrolls to be used. Moreover, it is within the scope of the invention for the brushroll 40 to be mounted within the agitator chamber 38 in a fixed or floating vertical position relative to the chamber 38 and lower housing 34.

The brushroll 40 can be operably coupled to and driven by the motor/fan assembly 36 in the motor cavity 30. The motor/fan assembly 36 can comprise a motor shaft 46 which is oriented substantially parallel to the surface to be cleaned and protrudes from the motor cavity 30 into a rear portion of the base 14. A drive belt 48 operably connects the motor shaft 46 to the brushroll 40 for transmitting rotational motion of the motor shaft 46 to the brushroll 40. Alternatively, a separate, dedicated agitator drive motor (not shown) can be provided within the base 14 to drive the brushroll 40.

The base 14 can further include an optional suction nozzle height adjustment mechanism for adjusting the height of the suction nozzle opening 42 with respect to the surface to be cleaned. A rotatable knob 54 for actuating the adjustment mechanism can be provided on the exterior of the base 14. In another variation, the suction nozzle height adjustment mechanism can be eliminated.

In operation, the vacuum cleaner 10 draws in debris-laden air through the base 14 and into the collection system 18 where the debris is substantially separated from the working air flow, which is generated by the motor/fan assembly 36. The spinning motor shaft 46 of the motor/fan assembly 36 rotates the brushroll 40 via the drive belt 48 that is operably connected therebetween. Alternatively, a separate, dedicated agitator drive motor can rotate the brushroll 40. As the brushroll 40 rotates, the bristles sweep across the surface to be cleaned to release and propel debris into the working air flow generated by the motor/fan assembly 36, which carries the debris into the collection system 18. The working air flow then passes through the motor cavity 30 and past the motor/fan assembly 36 prior to being exhausted from the vacuum cleaner 10. The collection system 18 can be periodically emptied of debris.

Figure 3:
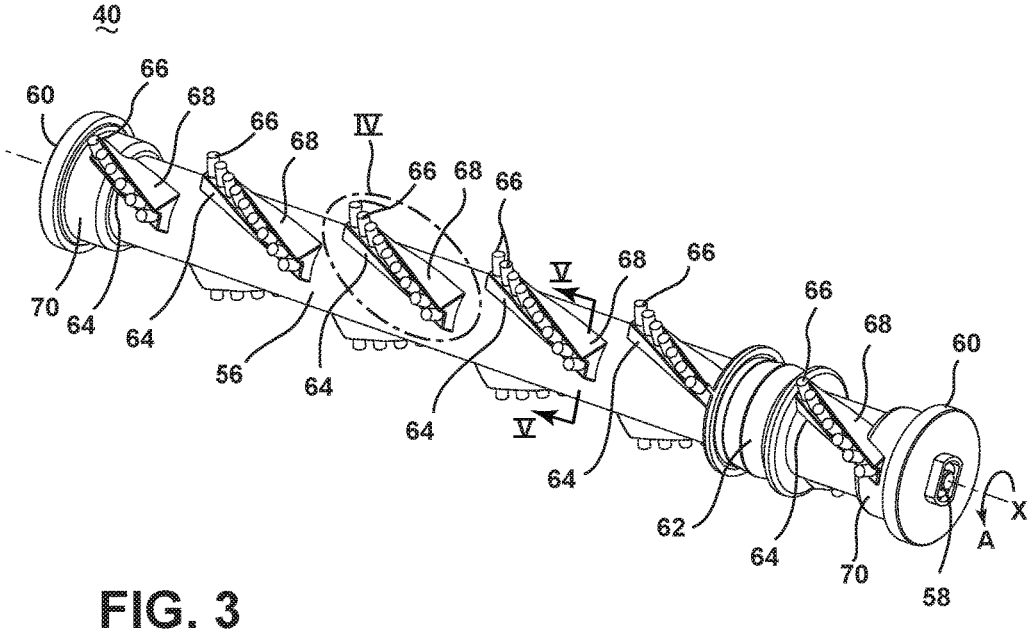
FIG. 3 is a perspective view of a brushroll according to a first embodiment of the invention.

FIG. 3 is a perspective view of a brushroll 40 according to a first embodiment of the invention. The brushroll 40 can be used with the vacuum cleaner 10 of FIG. 1-2, as described above. The brushroll 40 includes a generally cylindrical brush dowel 56 that is mounted on an elongated shaft 58 that extends through the center of the dowel 56 and defines the axis X around which the brushroll 40 rotates. A bearing 60 is mounted on both ends of the shaft 58 and in operation the dowel 56 rotates about the shaft 58 on the bearings 60. A belt engagement surface 62 around the circumference of the dowel 56 near one end communicates with the belt 44 (FIG. 2) and may comprise a pulley. The brushroll 40 is adapted to be rotationally driven in the direction indicated by arrow A.

A plurality of bristle ridges 64 project or extend from the exterior surface of the brush dowel 56. A plurality of bristle tufts 66 project or extend from each bristle ridge 64. Each bristle tuft 66 can include a plurality of flexible bristles, which may be made from a durable polymer material such as nylon or polyester, for example. Using the bristle ridges 64 to mount the bristle tufts 66 minimizes the amount of material needed for the dowel 56 by locally increasing the diameter of the dowel 56 where the bristle tufts 66 are attached, rather than increase the entire diameter of the dowel 56.

At least one bristle stiffener 68 projects or extends from each bristle ridge 64. The bristle stiffeners 68 are generally laterally coextensive with the bristle tufts 66, and can extend generally along the entire length of the bristle ridges 64. The bristle stiffeners 68 are positioned adjacent to a rear side of the bristle tufts 66, with "rear" in this case being defined in relation of the direction of rotation A, such that upon the bristle tufts 66 engaging a surface to be cleaned, the bristle tufts 66 are prevented from bending over too far by the bristle stiffeners 68. Overall, the bristle stiffeners 68 tend to keep the bristle tufts 66 more or less erect as they pass over the surface to be cleaned. The bristle stiffeners 68 are substantially rigid, and do not flex as the brushroll 40 rotates. Due to the presence of the bristle stiffeners 68, the bristle tufts 66 can be softer, which reduces the amount of power needed to rotate the brushroll 40. The bristle tufts 66 are less stiff than the bristle stiffeners 68, can flex somewhat as the brushroll 40 rotates, although the presence bristle stiffeners 68 prevents at least some of the flexure that that bristle tufts 66 would otherwise experience without the bristle stiffeners 68.

The bristle ridges 64 can be divided into two opposing rows extending along the dowel 56, with each row having multiple bristle ridges 64. The spacing between adjacent bristle ridges 64 can allow the rotating brushroll 40 to clear ribs on the lower housing 34 that prevent carpet from getting drawn into the suction nozzle opening 42 (FIG. 1). The tufts 66 of one bristle ridge 64 are arranged in a generally helix pattern in single row spirally around the outer circumference of the brush dowel 56. The angle at which the bristle tufts 66 are oriented can vary, but is illustrated as covering about 90 degrees per segment, which allows the dowel 56 to be moldable.

Spools 70 are formed at the ends of the dowel 56, adjacent to the bearings 60, for preventing hair and other debris from migrating along the dowel 56 towards the bearings 60. At least a portion of the bristle ridges 64, tufts 66, and stiffeners 68 at the ends of the dowel 56 can extend onto the spools 70.

Figure 4:
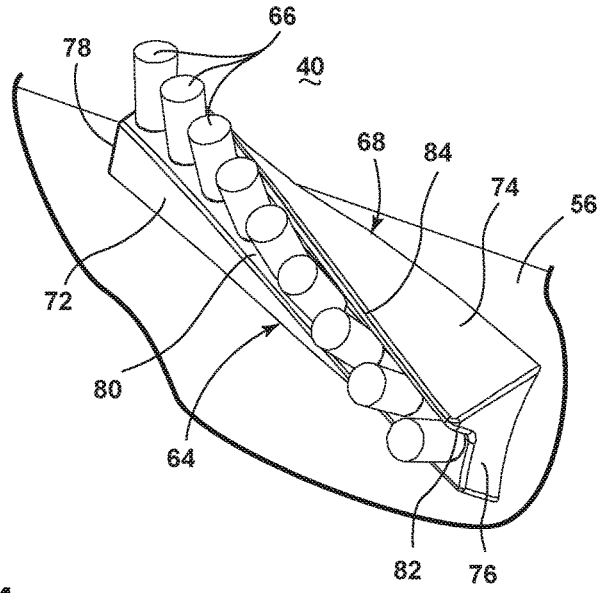
FIG. 4 is a close-up view of section IV of the brushroll from FIG. 3.

FIG. 4 is a close-up view of a portion of the brushroll 40 from FIG. 3. Each bristle ridge 64 has a leading surface 72 and a trailing surface 74, as defined by the direction of rotation, which project from the exterior surface of the brush dowel 56 and are joined by two end surfaces 76, 78 and an upper surface 80. The bristle stiffener 68 can be integrally formed with the bristle ridge 64, and can comprise an inner stiffener surface 82 which extends upwardly from the upper surface 80 to a stiffener edge 84 which joins the upper end of the trailing surface 74. The height of the leading and trailing surfaces 72, 74 can be substantially constant along the length of the surfaces 72, 74, but the trailing surface 74 can extend above the leading surface 72 to form the bristle stiffener 68. The stiffener edge 84 is positioned below the radial end of the bristle tufts 68.

Figure 5:
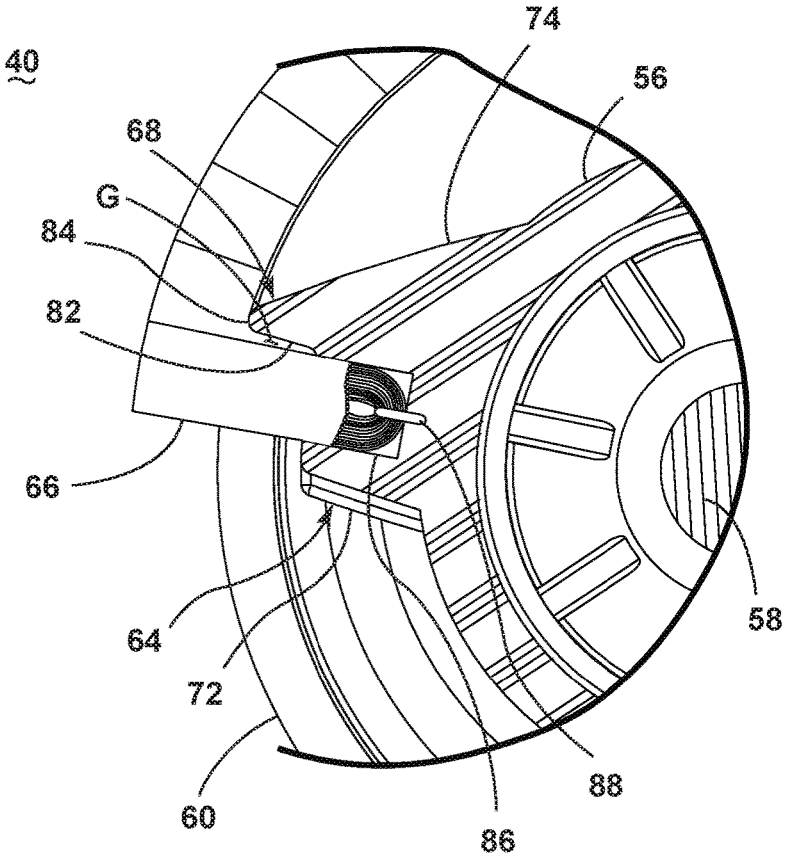
FIG. 5 is a close-up cross-sectional view of the brushroll taken through line V-V of FIG. 3.

The leading surface 72 and the trailing surface 74 can be non-planar, with a longitudinal twist formed in the leading surface 72 and the trailing surface 74, such that the second end surface 78 is radially offset from the first end surface 76. During rotation, bristle tufts 66 near the first end surface 76 will contact the surface to be cleaned first, with the bristle tufts 66 closer to the second end surface 78 sequentially following. The stiffener edge 84 braces the bristle tufts 66 to keep the bristle tufts 66 more or less erect as they pass over the surface to be cleaned FIG. 5 is a close-up cross-sectional view of the brushroll 40 taken through line 5-5 of FIG. 3. Bristle holes 86 can be formed in the upper surface 80 and extend at least partially into the bristle ridge 64. The bristle tufts 66 can be assembled to the dowel 56 by pressing bristles into the bristle holes 86 and securing the bristles using a fastener, such as a staple 88.

The bristle stiffener 68 can be adjacent to the bristle holes 86, such that there is a small gap G between the inner stiffener surface 82 and the closest portion of the bristle tuft 66. In one example, the gap G can be approximately 0.5 mm. During manufacturing, it is difficult to place the bristle tuft 66 close to the bristle stiffener 68 because the bristles are guided by a sleeve during tufting. By removing a portion of the tufting sleeve to clear the bristle stiffener 68, the bristle stiffener 68 itself can act as a guide to the tuft insertion on that the stiffener side. This allows the bristle tuft 66 to be located very close to the bristle stiffener 68.

Figure 6:
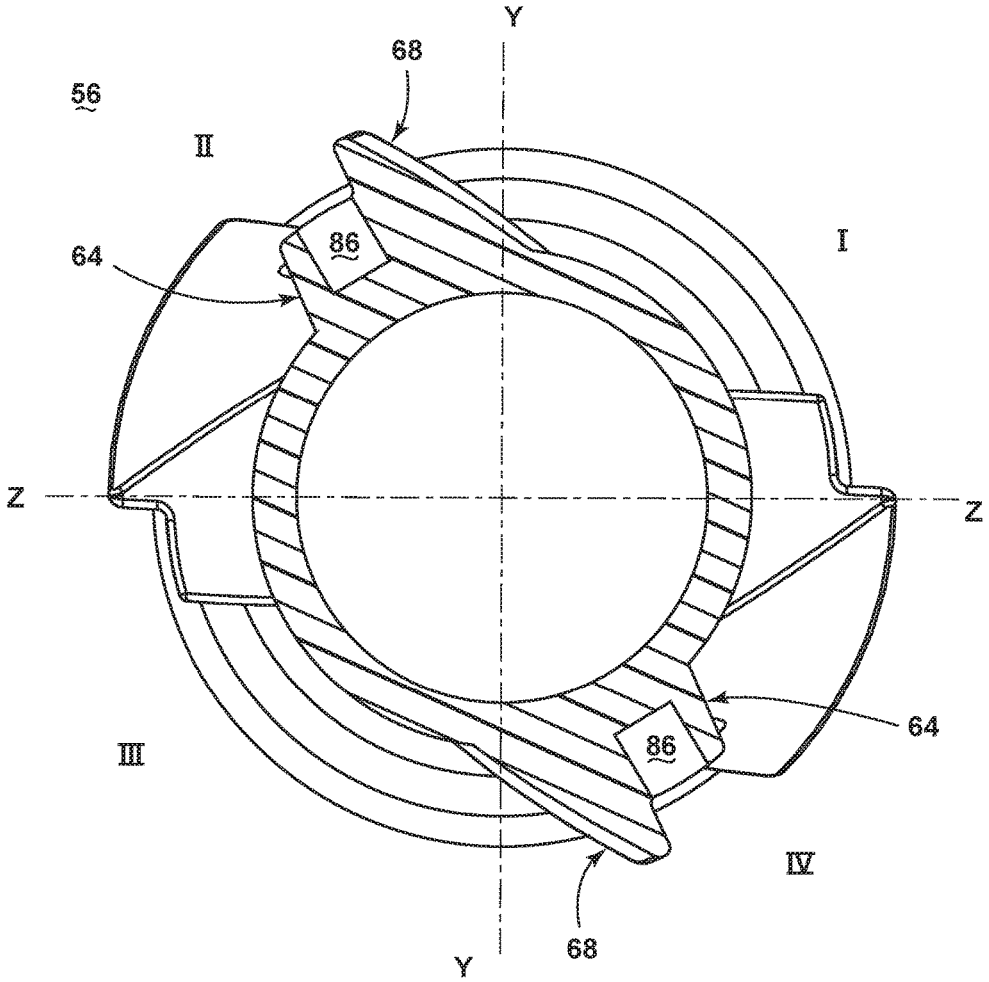
FIG. 6 is a cross-sectional view of a dowel of the brushroll taken through line V-V of FIG. 3.

FIG. 6 is a cross-sectional view of the dowel 56 taken through line V-V of FIG. 3. The dowel 56, including the bristle stiffeners 68, can be integrally molded in one-piece using a two-plate mold. In the embodiment shown, the bristle ridges 64 and bristle stiffeners 68 are tapered with an appropriate draft angle in the direction that the mold opens or the line of draw so that the dowel 56 can be released from the mold without additional actions or moving components such as slides or lifters, which are usually necessary for releasing die-locked or undercut part features from a mold. The draft angle can be defined as the angle formed between an interior mold wall and a vertical axis or plane. Typically, a draft angle of less than or equal to 90 degrees relative to vertical, which can also be referred to as a positive draft angle, is necessary to release a part feature from a two-plate mold. Conversely, a draft angle of greater than 90 degrees relative to vertical, which can be referred to as a negative draft angle, defines an undercut feature, which cannot be released from a two plate mold without additional actions or moving components in the mold. Conceptually, the dowel 56 can be divided into four quadrants I-IV, with a Y-axis and a Z-axis extending perpendicularly through the dowel 56 to define the four quadrants I-IV which proceeds in order in a counterclockwise direction around the dowel 56. The Y-axis and Z-axis meet at an origin defined by the rotational axis X around which the brushroll 40 rotates (see FIG. 3).

By confining the bristle stiffeners 68 to opposing quadrants of the dowel 56, undercuts on the dowel 56 can be eliminated, such that a two-part mold having a single line of draw, which may be defined along the Z axis, can be used to produce the dowel 56 without requiring the use of a movable slide or lifter in the mold, which can simplify the mold design and can reduce mold cost. In the illustrated embodiment, the bristle stiffeners 68 are in quadrants II and IV. The holes 86 for the bristle tufts 66 can be integrally formed in the dowel 56 during the molding process, or can be drilled into the dowel after molding.

Figure 7:
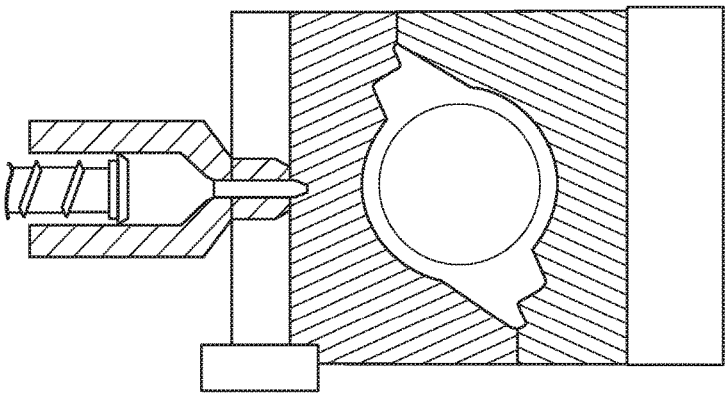
FIGS. 7-9 are schematic illustrations of an injection molding process which can be used to produce the dowel of FIG. 6.
Figure 8:
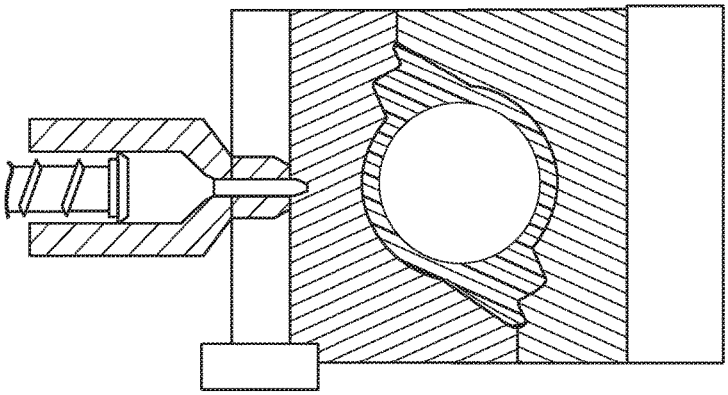
Figure 9:
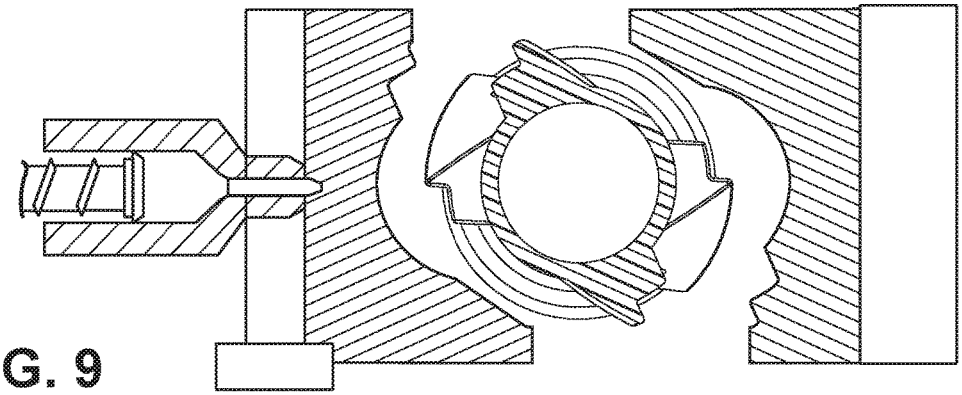

The dowel 56 of the brushroll 40 shown in FIG. 3-6 can be injection molded in accordance with the following method, illustrated in FIG. 7-9. The sequence of steps discussed is for illustrative purposes only and is not meant to limit the method in any way as it is understood that the steps may proceed in a different logical order, additional or intervening steps may be included, or described steps may be divided into multiple steps, without detracting from the invention. For FIGS. 7-9, it is noted that the parting line of the mold, which is the plane in which the two mold halves meet, is not linear, but extends along the length of the dowel 56 following the bristle stiffeners 68 most of the length of the dowel. In this embodiment, since the bristle stiffeners 68 wrap helically around the dowel 56 and are radially spaced from the rotational axis X of the dowel 56 (see FIG. 3), the parting line is likewise radially spaced from the rotational axis X of the dowel 56 and will be substantially helical, changing contour with the bristle stiffeners 68 and extending along the stiffener edge 84 of the bristle stiffeners 68. Thus, a parting line may show up as a raised line extending along the stiffener edge 84 of the bristle stiffeners 68 as a result of the molding, although a raised line is not necessarily always present. However, at any location along the dowel 56, the bristle stiffeners 68 are located in opposing quadrants as described with respect to FIG. 6. Other contours for the parting line are also possible in which the parting line is non-parallel to the rotational axis X. Here, a helical parting line is used; in other embodiments, an angled parting line is used.

FIG. 7 shows a two-plate mold having two mold halves which together define a cavity configured for producing the dowel of the brushroll, with the mold closed and ready for injection. A shot of melt material is injected under pressure into the cavity, as depicted in FIG. 8. The melt material can comprise a polymeric material, such as polypropylene, ABS, or styrene. When the material is cooled and solidified, the mold is opened and the dowel part is ejected and removed, as shown in FIG. 9. The two mold halves can separate from the molded dowel 56, allowing the molded dowel 56 to be ejected without obstruction from undercuts on the dowel 56. It should be noted that the injection molding process described herein is simplified, and other steps common to injection molding, such as heating the raw material prior to injection and/or applying packing pressure, may also be performed. Furthermore, additional finishing steps such as attaching the bristle tufts 66, inserting the shaft 58 and assembling the bearing holders 60 can also be performed to produce the brushroll 40.

Figure 10:
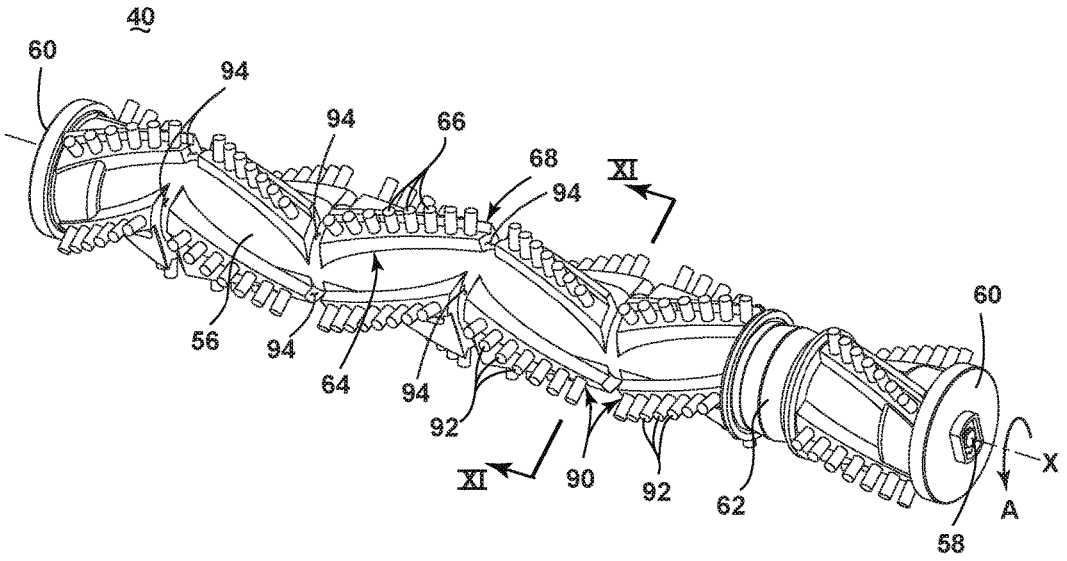
FIG. 10 is a perspective view of a brushroll according to a second embodiment of the invention.

FIG. 10 is a perspective view of a brushroll 40 according to a second embodiment of the invention, in which like elements are identified with the same reference numerals. The brushroll 40 can be used in place of the brushroll 40 on the vacuum cleaner 10 shown in FIGS. 1-2, and can be substantially similar to the brushroll 40 shown the first embodiment of FIG. 3, save for the orientation of the rows of bristle tufts 66 and the provision of additional rows of bristles.

In the embodiment shown, the bristle tufts 66 (and likewise the bristle ridges 64 and bristle stiffeners 68) can have a repeating chevron pattern, where bristle tufts 66 on adjacent bristle ridges 64 meet at angles, such that the first end surface 76 of one bristle ridge 64 is radially aligned with the second end surface 78 of the adjacent bristle ridge 64 but is radially offset from the first end surface 76 of the same adjacent bristle ridge 64.

A plurality of bristle ridges 90 can project or extend from the exterior surface of the brush dowel 56 and are arranged in two opposing rows extending along the dowel 56 between the opposing rows of bristle ridges 64. The bristle ridges 90 can be substantially identical to the bristle ridges 64, with the exception that they are not provided with bristle stiffeners 68. A plurality of bristle tufts 92 project or extend from each bristle ridge 90, and can be substantially identical to the bristle tufts 66. The bristle tufts 92 (and likewise the bristle ridges 90) can have a repeating chevron pattern which generally follows the chevron pattern of the intervening rows of bristle tufts 66. Circumferential gaps 94 extend around the dowel 56 and separate adjacent bristle ridges 64, 90 and allow the rotating brushroll 40 to clear ribs on the lower housing 34 that prevent carpet from getting drawn into the suction nozzle opening 42 (FIG. 1).

Figure 11:
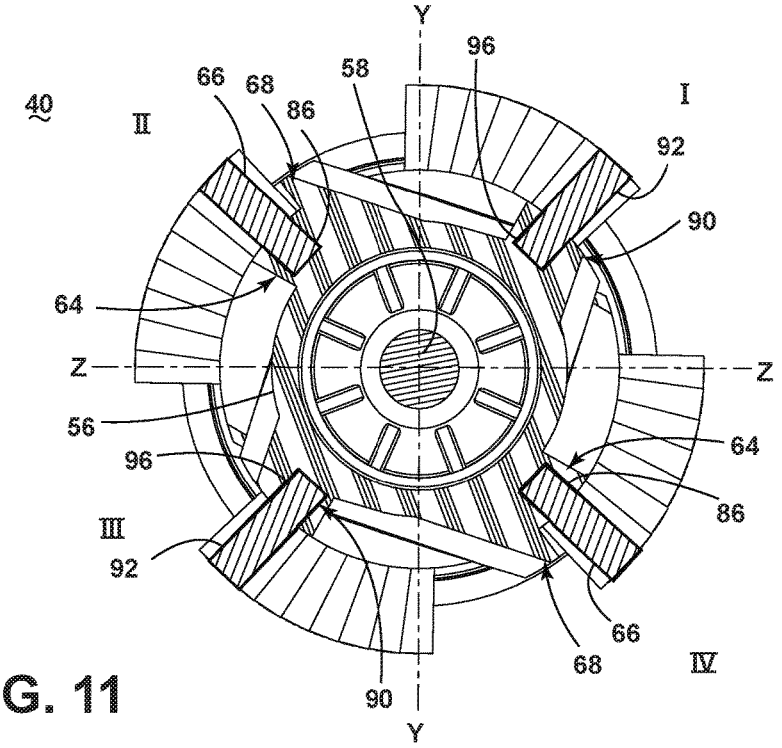
FIG. 11 is a cross-sectional view through line XI-XI of FIG. 10.

FIG. 11 is a cross-sectional view through line 11-11 of FIG. 10. Bristle holes 96 can be formed in the upper surface of the bristle ridges 90 and receive the bristle tufts 92. The individual bristles making up the bristle tufts 66, 90 are not for the sake of simplicity. Like the bristle tufts 66, the bristle tufts 90 can be assembled to the dowel 56 by pressing bristles into the bristle holes 96 and securing the bristles using a fastener (not shown), such as the staple 88 shown in FIG. 5. The height and stiffness of the bristle tufts 66, 90 can be substantially equal, such that there is a substantially constant bristle diameter and stiffness. Alternatively, the height and stiffness of the bristle tufts 66, 90 can vary.

Like the first embodiment, the dowel 56 can be integrally molded in one-piece using a two-plate mold. In the embodiment shown, the bristle ridges 90 in quadrants I and III are not provided with bristle stiffeners to avoid creating undercuts on the dowel 56, such that the only bristle stiffeners 68 provided on the dowel 56 are drafted in the line of draw, which may be defined along the Z axis. However, the bristle tufts 66, 92 can still be provided in all four quadrants I-IV to maintain a more balanced contact with the surface to be cleaned as the brushroll 40 rotates.

Figure 12:
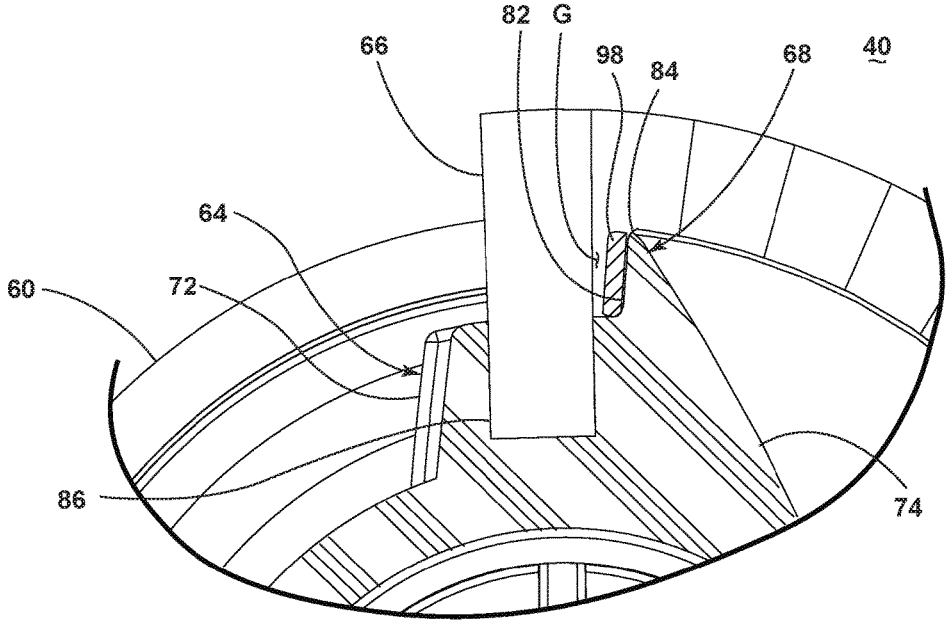
FIG. 12 is a close-up cross-sectional view similar to FIG. 5 of a brushroll according to a third embodiment of the invention.

FIG. 12 is a close-up cross-sectional view, similar to FIG. 5, of a brushroll 40 according to a third embodiment of the invention, in which like elements are identified with the same reference numerals. The brushroll 40 can be used in place of the brushroll 40 on the vacuum cleaner 10 shown in FIGS. 1-2, and can be substantially similar to the brushroll 40 shown the first embodiment of FIG. 3, save for the provision of a shim 98 between the bristle stiffener 68 and the bristle tufts 66. The shim 98 is positioned within the gap G between the inner stiffener surface 82 and the closest portion of the bristle tuft 66. The shim 98 can be added after injection molding to further reduce the effective size of the gap G. In one example, the size of the gap as molded can be approximately 3 mm and the thickness of the shim 98 can be approximately 2.5 mm, providing an effective gap of 0.5 mm.

The shim 98 can be a strip of flexible material, such as a hard rubber, which is attached to the inner stiffener surface 82 and extends the length and height of the bristle stiffener 68. In one example, the shim 98 can be adhered to the inner stiffener surface 82 using an adhesive.

Figure 13:
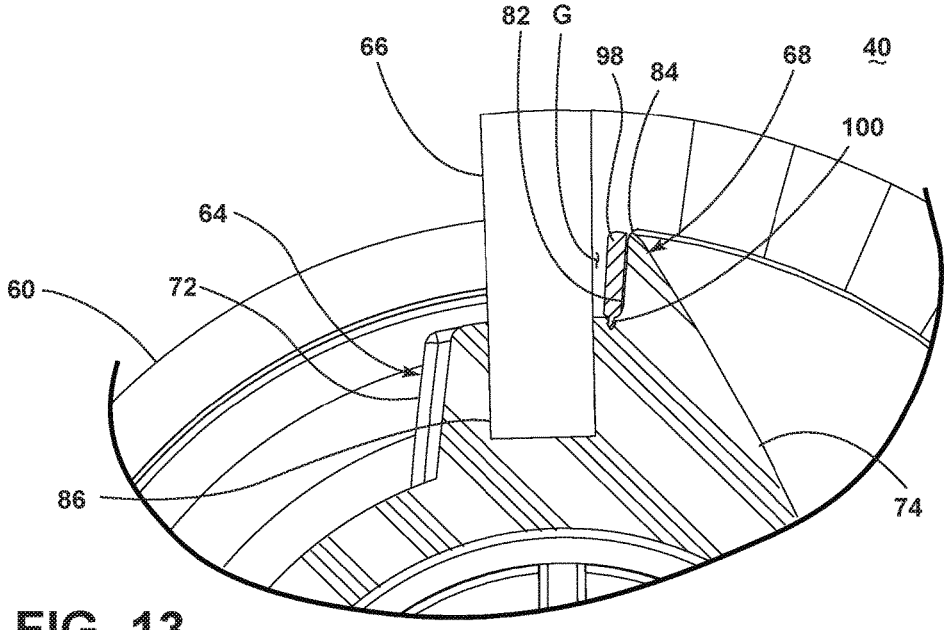
FIG. 13 is a close-up cross-sectional view similar to FIG. 5 of a brushroll according to a fourth embodiment of the invention.

FIG. 13 is a close-up cross-sectional view similar to FIG. 5 of a brushroll 40 according to a fourth embodiment of the invention. The brushroll 40 can be used in place of the brushroll 40 on the vacuum cleaner 10 shown in FIGS. 1-2, and can be substantially similar to the brushroll 40 shown the third embodiment of FIG. 12, except that the shim 98 can be strip of plastic or aluminum that is inserted into the dowel 56 after tufting. In this case, the shim 98 can be provided with tabs 100 that lock into holes drilled into the molded dowel 56. The shim 100 can be a stamped or molded part that can bend along the contour of the bristle stiffener 68.

Figure 14:
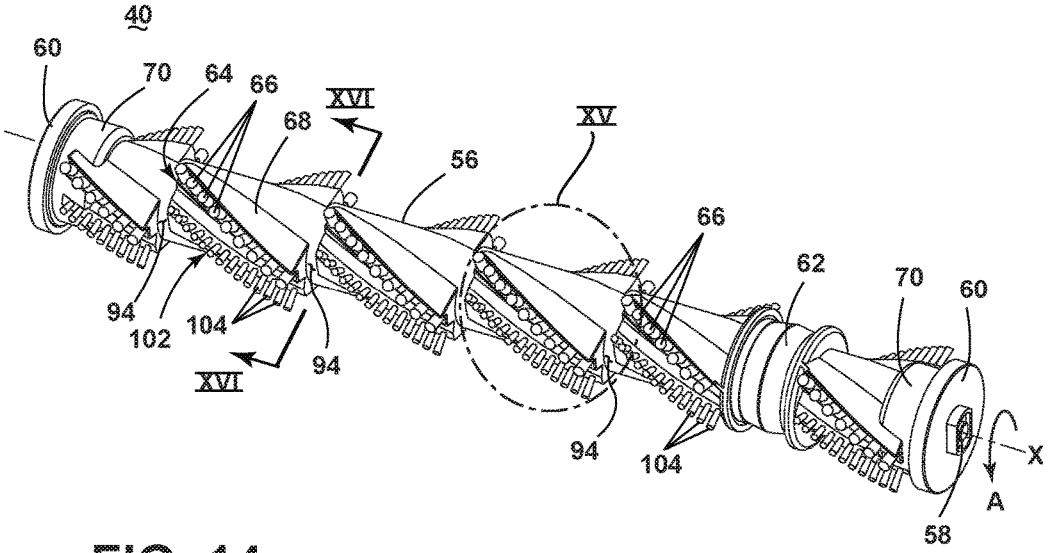
FIG. 14 is a perspective view of a brushroll according to a fifth embodiment of the invention.

FIG. 14 is a perspective view of a brushroll 40 according to a fifth embodiment of the invention, in which like elements are identified with the same reference numerals. The brushroll 40 can be used in place of the brushroll 40 on the vacuum cleaner 10 shown in FIGS. 1-2, and can be substantially similar to the brushroll 40 shown the first embodiment of FIG. 3, save for the provision of additional rows of bristle tufts.

A plurality of bristle ridges 102 can project or extend from the exterior surface of the brush dowel 56 and are arranged in two opposing rows extending along the dowel 56 closely adjacent to the opposing rows of bristle ridges 64, which allows the bristle ridges 64, 102 to be easily moldable with the dowel 56. A plurality of bristle tufts 104 can project or extend from each bristle ridge 102. Each bristle tuft 104 can include a plurality of flexible bristles, which may be made from a durable polymer material such as nylon or polyester, for example.

The bristle tufts 104 can be softer than the bristle tufts 66. For example, the bristles of the non-stiffened bristle tufts 104 can have a diameter of approximately 0.1 mm, with a 2.5 mm tuft diameter, and the bristles of the stiffened bristle tufts 66 can have a diameter of approximately 0.15-0.25 mm with 4.9 mm tuft diameter. The advantage of the additional row of non-stiffened bristle tufts 104 is that more of the 360 degrees of the dowel 56 will be covered with bristles, while still being moldable in a two plate injection mold without additional movable slides or lifters. The variation in tuft properties accommodates multiple floor surfaces, including both carpets and barefloors.

The bristle tufts 104 (and likewise the bristle ridges 102) can have a repeating pattern which generally follows the pattern of the rows of bristle tufts 66. The bristle ridges 102 are positioned adjacent to a front side of the bristle ridges 64, with "front" in this case being defined in relation of the direction of rotation A, such that upon rotation the bristle tufts 104 engage the surface to be cleaned just before the bristle tufts 66. The front bristle ridges 102 are not provided with bristle stiffeners. Circumferential gaps 94 extend around the dowel 56 and separate adjacent bristle ridges 64, 102 and allow the rotating brushroll 40 to clear ribs on the lower housing 34 that prevent carpet from getting drawn into the suction nozzle opening 42 (FIG. 1).

Figure 15:
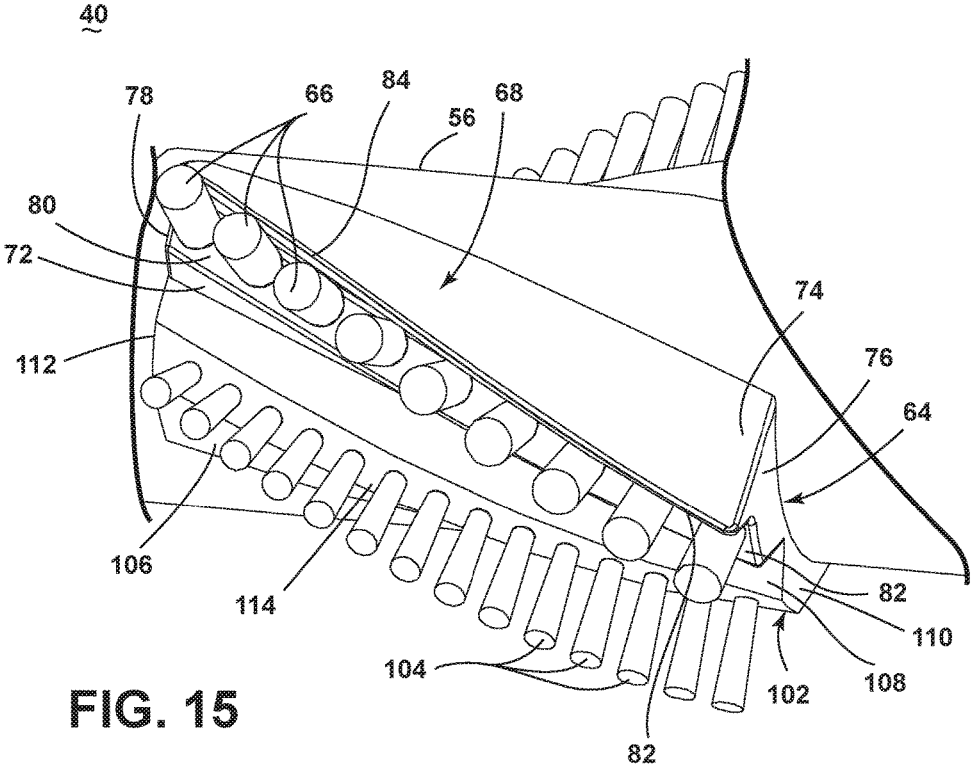
FIG. 15 is a close-up view of section XV of the brushroll from FIG. 14.

FIG. 15 is a close-up view of a portion of the brushroll 40 from FIG. 14. Each leading or front bristle ridge 102 has a leading surface 106 and a trailing surface 108, as defined by the direction of rotation, which project from the exterior surface of the brush dowel 56 and are joined by two end surfaces 110, 112 and an upper surface 114. The trailing surface 108 of the front bristle ridge 102 joins the leading surface 72 of the trailing or rear bristle ridge 64. Likewise, the end surfaces 110, 112 join the end surfaces 76, 78.

The leading surface 106 and the trailing surface 108 can be non-planar, with a longitudinal twist formed in the leading surface 106 and the trailing surface 108, such that the second end surface 112 is radially offset from the first end surface 110. During rotation, bristle tufts 104 near the first end surface 110 will contact the surface to be cleaned first, with the bristle tufts 106 closer to the second end surface 112 sequentially following.

Figure 16:
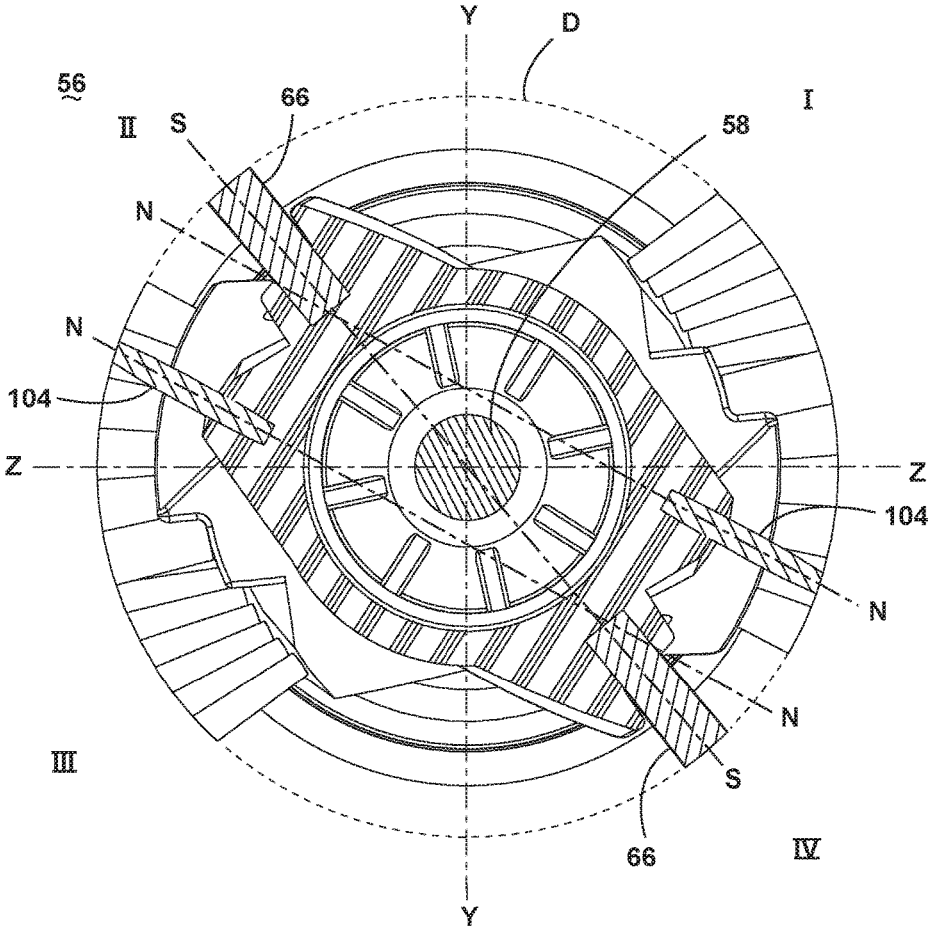
FIG. 16 is a cross-sectional view through line XVI-XVI of FIG. 14.

FIG. 16 is a cross-sectional view through line XVI-XVI of FIG. 14. Bristle holes 116 can be formed in the upper surface 114 and receive the bristle tufts 104. The individual bristles making up the bristle tufts 66, 104 are not for the sake of simplicity. Like the bristle tufts 66, the bristle tufts 104 can be assembled to the dowel 56 by pressing bristles into the bristle holes 116 and securing the bristles using a fastener, such as a staple (not shown), such as the staple 88 shown in FIG. 5.

The non-stiffened bristle tufts 104 can be dissimilar from the stiffened bristle tufts 66. For example, the stiffened bristle tufts 66 can extend substantially normal to the dowel 56, such that a centerline S passing through one of the bristle tufts 66 intersects the rotational axis X defined by the shaft 58, while the non-stiffened bristle tufts 104 can extend at an angle from the dowel 56, such that a centerline N passing through one of the bristle tufts 104 is offset from the rotational axis X defined by the shaft 58. The bristle tufts 66, 104 can also be trimmed to substantially the same diameter, such that there is a substantially constant bristle diameter D, which can lower manufacturing costs. During operation the angled, non-stiffened bristle tufts 104 expand to a diameter greater than D due to the centripetal force from the rotating brushroll 40, allowing the softer bristles to selectively contact a lower floor surface, such as a bare floor. The stiffened bristle tufts 66 do not expand due to the centripetal force, keeping the stiffer bristles out of contact with the lower floor surface. The non-stiffened bristle tufts 104 will sweep, but not scratch, a bare floor. The stiffened bristle tufts 66 only contact higher surfaces like carpet, which is more forgiving and requires more of a beating action to be effectively cleaned.

Like the first embodiment, the dowel 56 can be integrally molded in one-piece using a two-plate mold. In the embodiment shown, the bristle ridges 102 in quadrants I and III are not provided with bristle stiffeners to avoid creating undercuts on the dowel 56, such that the only bristle stiffeners 68 provided on the dowel 56 are drafted in the line of draw, which may be defined along the Z axis. However, the bristle tufts 66, 104 can still be provided in all four quadrants I-IV to maintain a more balanced contact with the surface to be cleaned as the brushroll 40 rotates.

Figure 17:
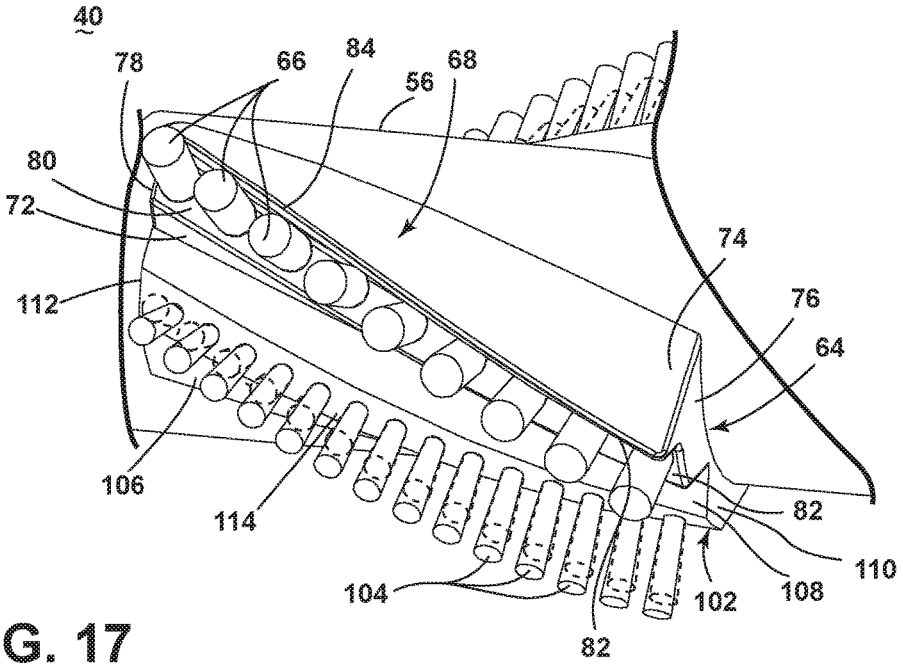
FIG. 17 is a perspective view of a brushroll according to a sixth embodiment of the invention.

FIG. 17 is a perspective view of a brushroll 40 according to a sixth embodiment of the invention, in which like elements are identified with the same reference numerals. The brushroll 40 can be used in place of the brushroll 40 on the vacuum cleaner 10 shown in FIGS. 1-2, and can be substantially similar to the brushroll 40 shown the fifth embodiment of FIG. 14-16, save for the rows of non-stiffened bristle tufts 104. In this embodiment, the non-stiffened bristle tufts 104 are normal to the dowel 56, whereby the non-stiffened bristle tufts 104 lie at an angle with respect to their position in FIG. 14, as shown by the phantom lines indicating the position of the non-stiffened bristle tufts 104 in FIG. 14.

Figure 18:
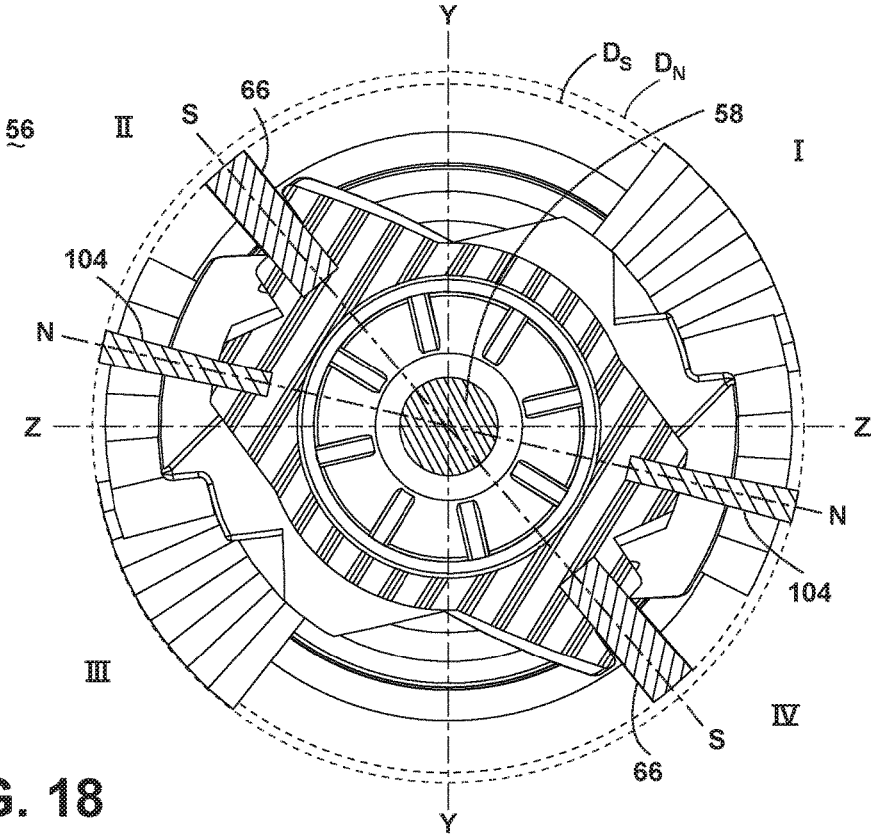
FIG. 18 is a cross-sectional view through the brushroll of FIG. 17.

FIG. 18 is a cross-sectional view through the brushroll 40 of FIG. 17. In this embodiment, like the stiffened bristle tufts 66, the non-stiffened bristle tufts 104 can extend substantially normal to the dowel 56, such that the centerline N passing through one of the bristle tufts 104 intersects the rotational axis X defined by the shaft 58. Also, the non-stiffened bristle tufts 104 are not trimmed to the same diameter as the stiffened bristle tufts 66, such that the non-stiffened bristle tufts 104 are longer and define a larger bristle diameter $D_N$ than the stiffened bristle tufts 66, which are shorter and define a smaller bristle diameter $D_S$. The non-stiffened bristle tufts 104 will sweep, but not scratch, a bare floor. The stiffened bristle tufts 66 only contact higher surfaces like carpet, which is more forgiving and requires more of a beating action to be effectively cleaned.

Like the first embodiment, the dowel 56 can be integrally molded in one piece using a two-plate mold. In the embodiment shown, the bristle ridges 102 in I and III are not provided with bristle stiffeners to avoid creating undercuts on the dowel 56, such that the only bristle stiffeners 68 provided on the dowel 56 are drafted in the line of draw, which may be defined along the Z axis. However, the bristle tufts 66, 104 can still be provided in all four quadrants I-IV to maintain a more balanced contact with the surface to be cleaned as the brushroll 40 rotates.

Figure 19:
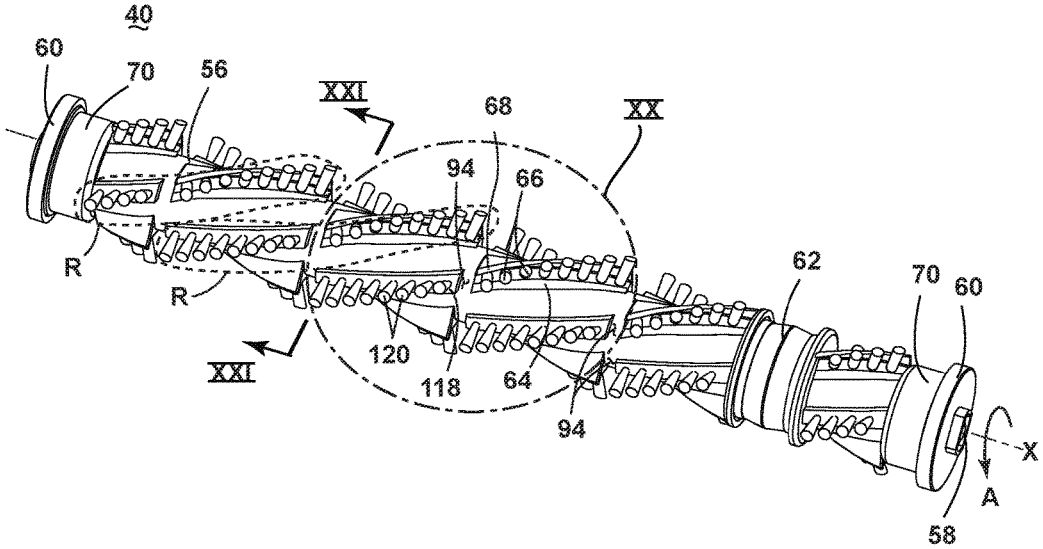
FIG. 19 is a perspective view of a brushroll according to a seventh embodiment of the invention.

FIG. 19 is a perspective view of a brushroll 40 according to a seventh embodiment of the invention, in which like elements are identified with the same reference numerals. The brushroll 40 can be used in place of the brushroll 40 on the vacuum cleaner 10 shown in FIGS. 1-2, and can be substantially similar to the brushroll 40 shown the first embodiment of FIG. 3, save for the provision of additional rows of bristles, the orientation of the rows, and the provision of some non-stiffened bristles in the rows. In the embodiment shown, four helical rows R of bristles are provided, with each row made up of a repeating pattern of stiffened bristles and non-stiffened bristles. The rows R can be spaced substantially evenly about the dowel 56 to maintain a more balanced contact with the surface to be cleaned as the brushroll 40 rotates.

The stiffened bristle tufts 66 are substantially similar to those described above, and are provided on bristle ridges 64 having bristle stiffeners 68. A plurality of bristle ridges 118 can project or extend from the exterior surface of the brush dowel 56 and are arranged in between the bristle ridges 64. The bristle ridges 118 are not provided with bristle stiffeners. A plurality of bristle tufts 120 can project or extend from each bristle ridge 118. Each bristle tuft 120 can include a plurality of flexible bristles, which may be made from a durable polymer material such as nylon or polyester, for example. The bristle tufts 120 can have a stiffness substantially the same as the bristle tufts 66, and can flex as the brushroll 40 rotates. Circumferential gaps 94 extend around the dowel 56 and separate adjacent bristle ridges 64, 120 and allow the rotating brushroll 40 to clear ribs on the lower housing 34 that prevent carpet from getting drawn into the suction nozzle opening 42 (FIG. 1).

Figure 20:
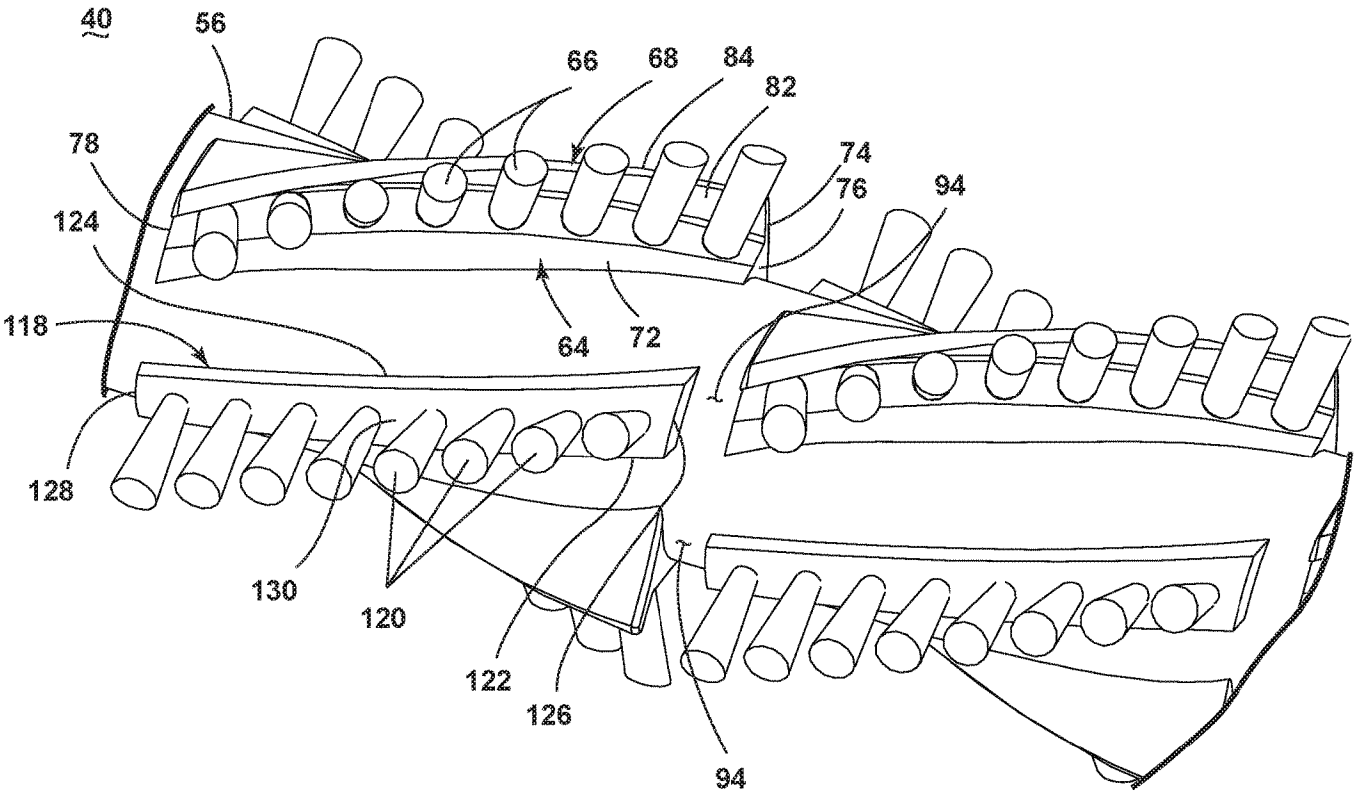
FIG. 20 is a close-up view of section XX of the brushroll from FIG. 19.

FIG. 20 is a close-up view of a portion of the brushroll 40 from FIG. 19. Each non-stiffened bristle ridge 118 has a leading surface 122 and a trailing surface 124, as defined by the direction of rotation, which project from the exterior surface of the brush dowel 56 and are joined by two end surfaces 126, 128 and an upper surface 130. The leading surface 122 and the trailing surface 124 can be non-planar, with a longitudinal twist formed in the leading surface 122 and the trailing surface 124. During rotation, bristle tufts 120 near the second end surface 128 will contact the surface to be cleaned first, with the bristle tufts 120 closer to the first end surface 126 sequentially following.

In the embodiment shown, the bristle tufts 66, 120 can have a repeating helically-extending pattern, where the circumferential gaps 94 separate the stiffened and non-stiffened bristle ridges 64, 118, such that the first end surface 76 of one stiffened bristle ridge 64 is aligned with the second end surface 128 of one adjacent non-stiffened bristle ridge 118 and the second end surface 78 of the same stiffened bristle ridge 64 is aligned with the first end surface 126 of the other adjacent non-stiffened bristle ridge 118, but is radially offset from the first end surface 76.

Figure 21:
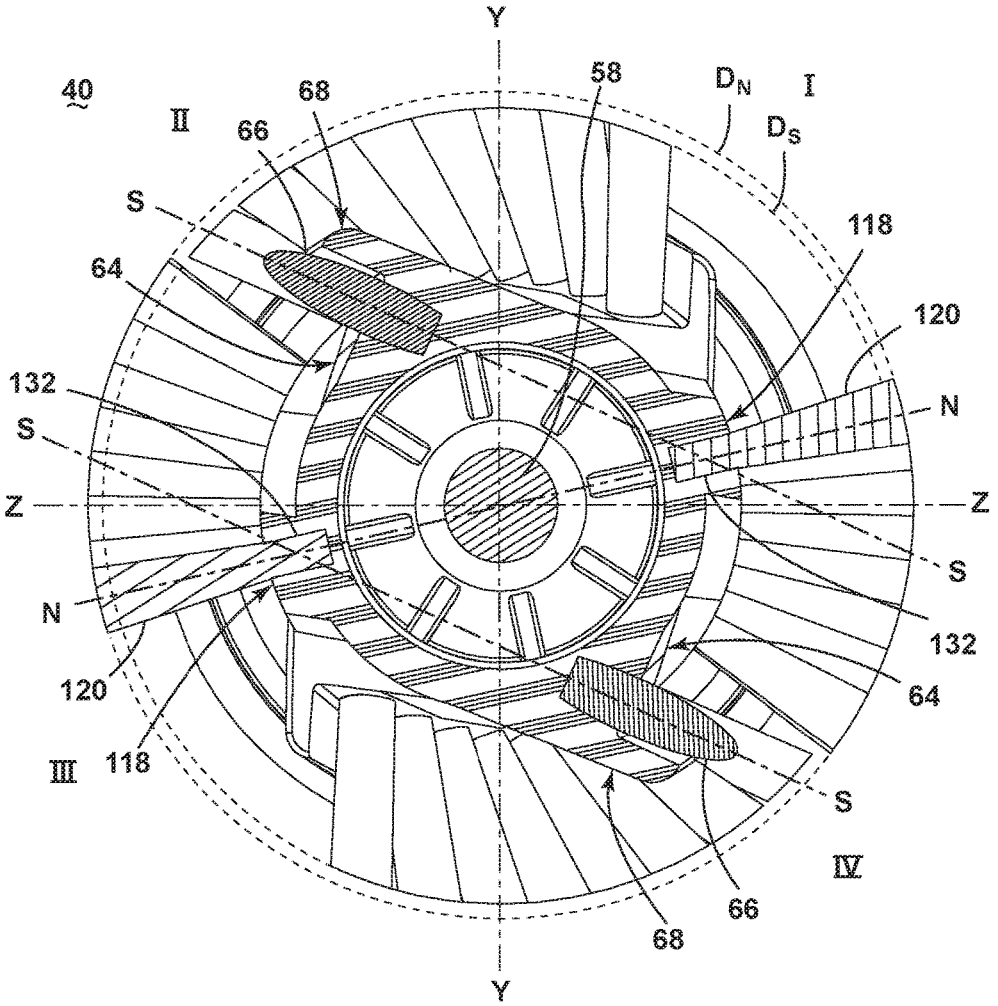
FIG. 21 is a cross-sectional view through line XXI-XXI of FIG. 19.

FIG. 21 is a cross-sectional view through line XXI-XXI of FIG. 19. Bristle holes 132 can be formed in the non-stiffened bristle ridge 118 and receive the bristle tufts 120. The individual bristles making up the bristle tufts 66, 120 are not for the sake of simplicity. Like the bristle tufts 66, the bristle tufts 120 can be assembled to the dowel 56 by pressing bristles into the bristle holes 132 and securing the bristles using a fastener (not shown), such as the staple 88 shown in FIG. 5.

The non-stiffened bristle tufts 120 can be dissimilar from the stiffened bristle tufts 66. For example, the non-stiffened bristle tufts 120 can extend substantially normal to the dowel 56, such that the centerline N passing through one of the bristle tufts 120 intersects the rotational axis X defined by the shaft 58, while the stiffened bristle tufts 66 can extend at an angle from the dowel 56, such that the centerline S passing through one of the bristle tufts 66 is offset from the rotational axis X defined by the shaft 58. Also, the non-stiffened bristle tufts 120 are not trimmed to the same diameter as the stiffened bristle tufts 66, such that the non-stiffened bristle tufts 120 are longer and define a larger bristle diameter $D_N$ than the stiffened bristle tufts 66, which are shorter and define a smaller bristle diameter $D_S$.

In this embodiment, the stiffened bristle tufts 66 are angled into the direction of rotation, increasing the aggressiveness of the beating action on carpet. This allows the stiffened bristle tuft 66 to be manufactured farther from the bristle stiffener 68 while maintaining a perpendicular orientation to the surface to be cleaned after the bristle tuft 66 is deflected by the carpet and until it comes into contact with the bristle stiffener 68.

Like the first embodiment, the dowel 56 can be integrally molded in one-piece using a two-plate mold. In the embodiment shown, the bristle ridges 118 in quadrants I and III are not provided with bristle stiffeners to avoid creating undercuts on the dowel 56, such that the only bristle stiffeners 68 provided on the dowel 56 are drafted in the line of draw, which may be defined along the Z axis. However, the bristle tufts 66, 120 can still be provided in all four quadrants I-IV to maintain a more balanced contact with the surface to be cleaned as the brushroll 40 rotates.

Figure 22:
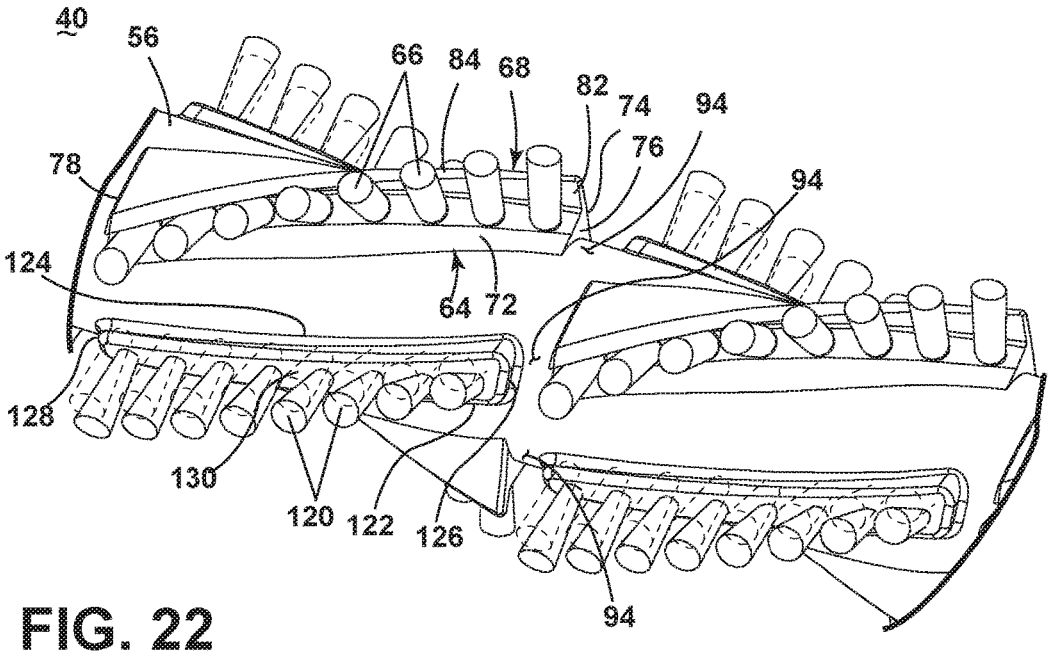
FIG. 22 is a perspective view of a brushroll according to an eighth embodiment of the invention.

FIG. 22 is a perspective view of a brushroll 40 according to an eighth embodiment of the invention, in which like elements are identified with the same reference numerals. The brushroll 40 can be used in place of the brushroll 40 on the vacuum cleaner 10 shown in FIGS. 1-2, and can be substantially similar to the brushroll 40 shown the seventh embodiment of FIG. 19-21, save for the rows of non-stiffened bristle tufts 120. In this embodiment, the non-stiffened bristle tufts 120 are offset with respect to their position in FIG. 19, as shown by the phantom lines indicating the position of the non-stiffened bristle tufts 120 in FIG. 19.

Figure 23:
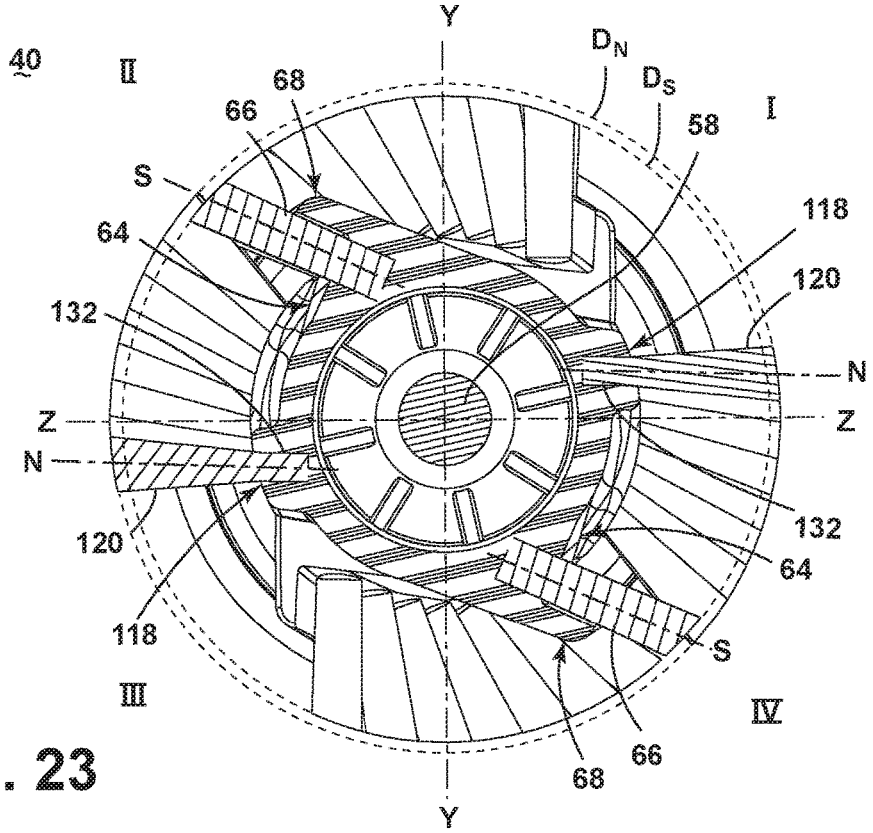
FIG. 23 is a cross-sectional view through the brushroll of FIG. 22.

FIG. 23 is a cross-sectional view through the brushroll 40 of FIG. 22. In this embodiment, like the stiffened bristle tufts 66, the non-stiffened bristle tufts 120 can extend at an angle from the dowel 56, such that the centerline N passing through one of the bristle tufts 120 is offset from the rotational axis X defined by the shaft 58. The bristle tufts 66, 120 can also be trimmed to substantially the same diameter, such that there is a substantially constant bristle diameter D, which can lower manufacturing costs. During operation the angled, non-stiffened bristle tufts 120 expand to a diameter greater than D due to the centripetal force from the rotating brushroll 40, allowing the softer bristles to selectively contact a lower floor surface, such as a bare floor. The stiffened bristle tufts 66 do not expand due to the centripetal force, keeping the stiffer bristles out of contact with the lower floor surface. The non-stiffened bristle tufts 104 will sweep, but not scratch, a bare floor. The stiffened bristle tufts 66 only contact higher surfaces like carpet, which is more forgiving and requires more of a beating action to be effectively cleaned.

In this embodiment, the stiffened bristle tufts 66are angled into the direction of rotation, increasing the aggressiveness of the beating action on carpet. This allows the stiffened bristle tuft 66 to be manufactured farther from the bristle stiffener 68 while maintaining a perpendicular orientation to the surface to be cleaned after the bristle tuft 66 is deflected by the carpet and until it comes into contact with the bristle stiffener 68.

Like the first embodiment, the dowel 56 can be integrally molded in one-piece using a two-plate mold. In the embodiment shown, the bristle ridges 118 in quadrants I and III are not provided with bristle stiffeners to avoid creating undercuts on the dowel 56, such that the only bristle stiffeners 68 provided on the dowel 56 are drafted in the line of draw, which may be defined along the Z axis. However, the bristle tufts 66, 104 can still be provided in all four quadrants I-IV to maintain a more balanced contact with the surface to be cleaned as the brushroll 40 rotates.

Figure 24:
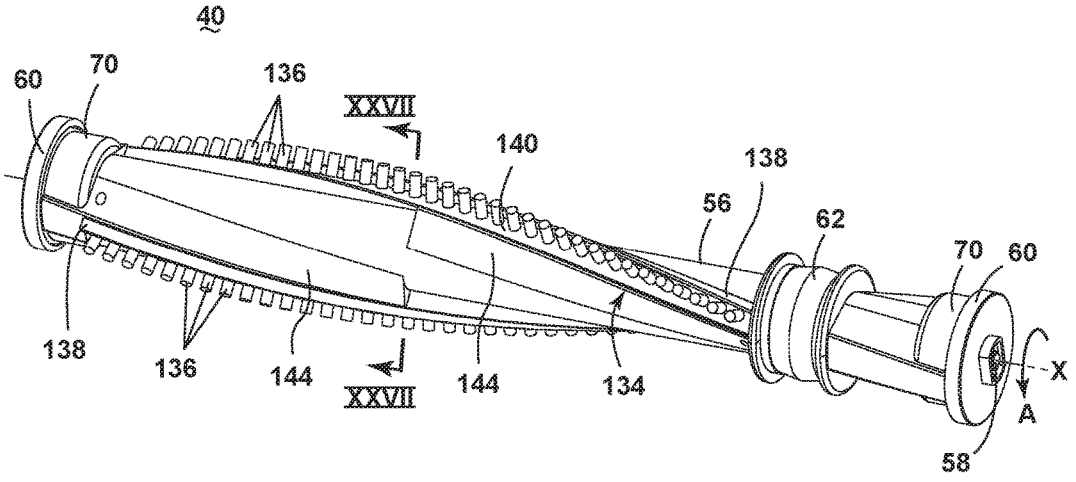
FIG. 24 is a perspective view of a brushroll according to a ninth embodiment of the invention.

FIG. 24 is a perspective view of a brushroll 40 according to a ninth embodiment of the invention, in which like elements are identified with the same reference numerals. The brushroll 40 can be used in place of the brushroll 40 on the vacuum cleaner 10 shown in FIGS. 1-2, and can be substantially similar to the brushroll 40 shown the first embodiment of FIG. 3, save for the agitation features provided on the dowel 56, as described below.

A plurality of bristle ridges 134 project or extend from the exterior surface of the brush dowel 56. A plurality of bristle tufts 136 can project or extend from each bristle ridge 134. Each bristle tuft 136 can include a plurality of flexible bristles, which may be made from a durable polymer material such as nylon or polyester, for example.

At least one bristle stiffener 138 projects or extends from each bristle ridge 134. The bristle stiffeners 138 are generally coextensive with the bristle tufts 136, and can extend generally along the entire length of the bristle ridges 134. The bristle stiffeners 138 are positioned adjacent to a rear side of the bristle tufts 136, with "rear" in this case being defined in relation of the direction of rotation A. The bristle stiffeners 138 are substantially rigid, and do not flex as the brushroll 40 rotates. The bristle tufts 136 are less stiff than the bristle stiffeners 138, can flex somewhat as the brushroll 40 rotates, although the presence bristle stiffeners 138 prevents at least some of the flexure that that bristle tufts 136 would otherwise experience without the bristle stiffeners 138.

As shown herein two opposing bristle ridges 134 extend along the dowel 56, with each bristle ridge 134 formed as an elongated strip 140 wrapping around the circumference of the dowel and defining a row of bristle tufts 136. Each strip 140 has multiple bristle tufts 136 and a single, continuous bristle stiffener 138. The bristle ridges 134, and thus the bristle tufts 1336 and stiffeners 138, are arranged in a generally helix pattern spiraling around the outer circumference of the brush dowel 56.

Figure 25:
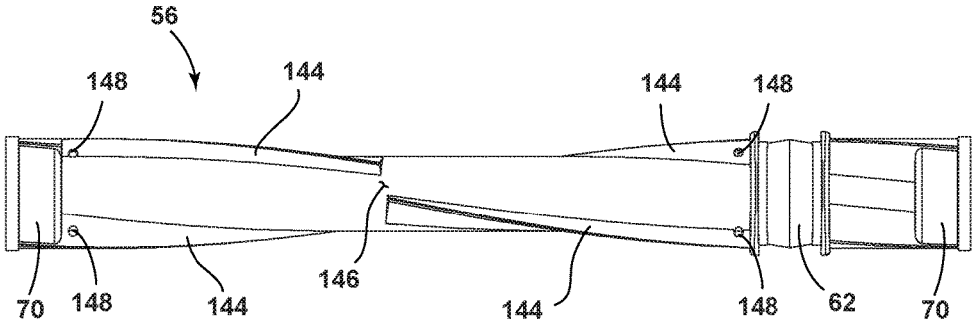
FIG. 25 is a plan view of a dowel of the brushroll from FIG. 24.

FIG. 25 is a plan view of the dowel 56. The dowel 56 can be provided with pairs of molded dowel ridges 144 that define a slot 146 in which the strips 140 can be inserted. The brush dowel 56 can be integrally molded, as described above.

Figure 26:
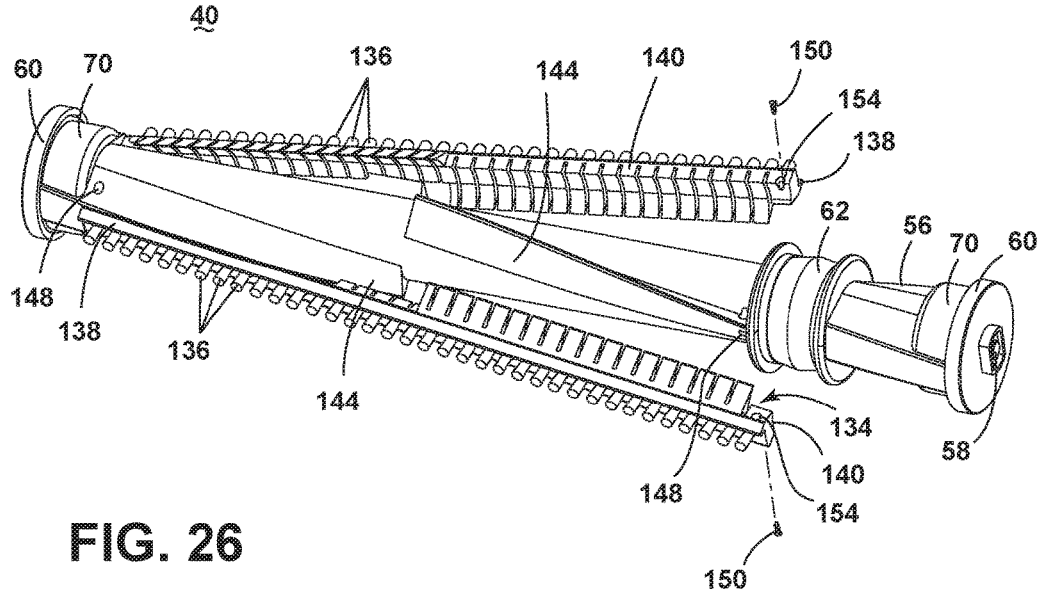
FIG. 26 is a partially exploded view of the brushroll from FIG. 24.

FIG. 26 is a partially exploded view of the brushroll 40 from FIG. 24. The dowel ridges 144 can be provided with one or more holes 148 for receiving a mechanical fastener, such as screw 150, for securing the strips 140 to the dowel 56. The bend of the dowel ridges 1400 allow the holes 148 to be drilled into the dowel 56 in the line of draw. The strips 140 can likewise be provided with holes 154 for receiving the screws 150. To assemble the bristles ridges 134 to the dowel 56, the strips 140 can be slid in between the dowel ridges 144 and secured with the screws 150. As shown, the bristles tufts 136 can be tufted into the strips 140 prior to assembling the strips 140 with the dowel 56.

Figure 27:
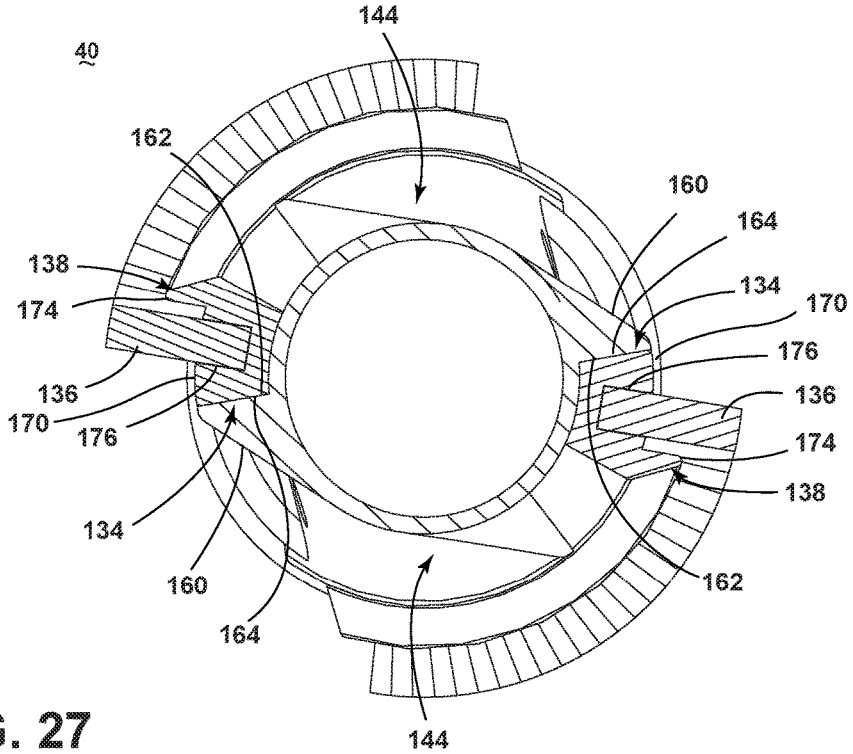
FIG. 27 is a cross-sectional view through line XXVII-XXVII of FIG. 24.

FIG. 27 is a cross-sectional view through line XXVII-XXVII of FIG. 24. Each dowel ridge 144 has a leading surface 160 and a trailing surface 162, as defined by the direction of rotation, that project from the exterior surface of the brush dowel 56. Each bristle ridges 134 has a leading surface 164 and a trailing surface 166 that project from the exterior surface of the brush dowel 56 and are joined by an upper surface 168. The leading surface 164 of the bristle ridge 134 can be flush against trailing surface 162 of the dowel ridge 144. The bristle stiffener 138 can be integrally formed with the bristle ridge 134, and can comprise an inner stiffener surface 172 which extends upwardly form the upper surface 170 to a stiffener edge 174 which joins the upper end of the trailing surface 166.

Bristle holes 176 can be formed in the upper surface 170 and extend at least partially into the bristle ridge 134. The bristle tufts 136 can be assembled to the dowel 56 by pressing bristles into the bristle holes 176 and securing the bristles using a fastener (not shown), such as a staple 88 as in FIG. 5.

The bristle stiffener 138 can be adjacent to the bristle holes 176, such that there is a small gap G between the inner stiffener surface 172 and the closest portion of the bristle tuft 136. In one example, the gap G can be approximately 0.5 mm.

Figure 28:
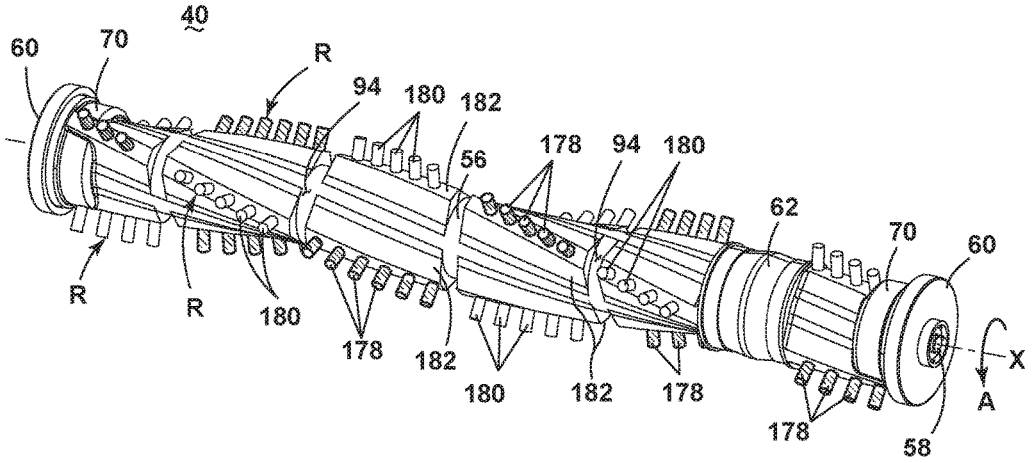
FIG. 28 is a perspective view of a brushroll according to a tenth embodiment of the invention.

FIG. 28 is a perspective view of a brushroll 40 according to a tenth embodiment of the invention, in which like elements are identified with the same reference numerals. The brushroll 40 can be used in place of the brushroll 40 on the vacuum cleaner 10 shown in FIGS. 1-2, and can be substantially similar to the brushroll 40 shown the first embodiment of FIG. 3, save for the agitation features provided on the dowel 56, as described below.

In the embodiment shown, multiple helical rows R of bristles are provided, with each row made up of a repeating pattern of stiffer bristles 178 and softer bristles 180. The rows R can be spaced substantially evenly about the dowel 56, which maintains a balanced contact with the surface to be cleaned as the brushroll 40 rotates. Preferably, 2-4 rows R are provided.

A plurality of bristle ridges 182 project or extend from the exterior surface of the brush dowel 56, with the stiffer bristles 178 projecting or extending from alternating bristle ridges 182 and the softer bristles 180 projecting or extending from the intervening bristle ridges 182. Each bristle tuft 178, 180 can include a plurality of flexible bristles, which may be made from a durable polymer material such as nylon or polyester, for example. The bristle ridges 182 do not include bristle stiffeners. Circumferential gaps 94 extend around the dowel 56 and separate adjacent bristle ridges 182 and allow the rotating brushroll 40 to clear ribs on the lower housing 34 that prevent carpet from getting drawn into the suction nozzle opening 42 (FIG. 1).

By providing a combination stiffer and softer bristles 178, 180, the brushroll 40 is effective on multiple types of floor surfaces. The stiffer bristles 178 allow deeper penetration of carpet, while the softer bristles 180 perform well on hard surfaces including bare floors. The stiffer and softer bristles 178, 180 can be trimmed to substantially the same diameter, such that there is a substantially constant bristle diameter, which can lower manufacturing costs. Alternatively, the softer bristles 180 can be longer than the stiffer bristles 178.

During operation the softer bristles 180 can expand to a larger diameter due to the centripetal force from the rotating brushroll 40, allowing the softer bristles 180 to selectively contact a lower floor surface, such as a bare floor. The stiffer bristles 178 do not expand due to the centripetal force, keeping the stiffer bristles 178 out of contact with the lower floor surface. The softer bristles 180 will sweep, but not scratch, a bare floor. The stiffer bristles 178 only contact higher surfaces like carpet, which is more forgiving and requires more of a beating action to be effectively cleaned.

The brush dowel 56, including the bristle ridges 182, can be integrally molded, as described above, with the bristle tufts 178, 180 assembled to the dowel 56 by pressing bristles into bristle holes (not shown) drilled into the molded dowel 56 and securing the bristles using a fastener (not shown), such as a staple 88 as in FIG. 5.

Figure 29:
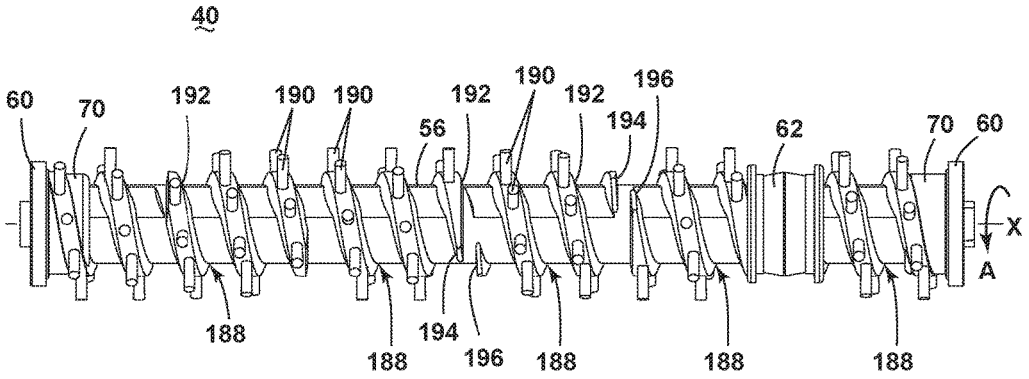
FIG. 29 is a perspective view of a brushroll according to an eleventh embodiment of the invention.

FIG. 29 is a perspective view of a brushroll 40 according to an eleventh embodiment of the invention, in which like elements are identified with the same reference numerals. The brushroll 40 can be used in place of the brushroll 40 on the vacuum cleaner 10 shown in FIGS. 1-2, and can be substantially similar to the brushroll 40 shown the first embodiment of FIG. 3, save for the agitation features provided on the dowel 56, as described below.

A plurality of bristle ridges 188 project or extend from the exterior surface of the brush dowel 56. A plurality of bristle tufts 190 can project or extend from each bristle ridge 188. Each bristle tuft 190 can include a plurality of flexible bristles, which may be made from a durable polymer material such as nylon or polyester, for example.

The bristle ridges 188 can be formed as helical ribs 192 which extend around the circumference of the dowel 56 at least one time. The helical ribs 192 have a relatively narrow width along the longitudinal axis X in comparison to the width of the bristle ridges of the previous embodiments. As shown herein, each helical rib 192 extends around the dowel 56 multiple times, from a first end 194 to a second end 196. The first and second ends 194, 196 of adjacent helical ribs 192 can partially overlap, such that an effectively continuous helical bristle ridge 188 is provided along the length of the dowel 56, but are laterally spaced from each other so that the rotating brushroll 40 can clear ribs on the lower housing 34 that prevent carpet from being drawn into the suction nozzle opening 42 (FIG. 1). The turns of the helical ribs 192 can be relatively close together, with a spacing of 20 mm and a pitch angle of 60 degrees. The helical ribs 192 can act as an auger which directs air and debris toward the suction nozzle opening 42 (FIG. 2).

Each helical rib 192 can have multiple bristle tufts 190 extending radially from an outer peripheral surface of the helical rib 192. The tufts 190 of each helical rib 192 are spaced from each other such that the bristles of one tuft 190 do not intersect or touch the bristles from another tuft 190. The tufts 190 are organized across the dowel 56 in an opposing helical pattern to the helical rib 192. This provides a precessing motion to the tufts 190 as the brushroll 40 rotates, akin to the action of fingers drumming on a table, which opens or parts carpet fibers in a spaced, even path.

The brush dowel 56, including the bristle ridges 188, can be integrally molded, as described above, with the bristle tufts 190 assembled to the dowel 56 by pressing bristles into bristle holes (not shown) drilled into the molded dowel 56 and securing the bristles using a fastener (not shown), such as a staple 88 as in FIG. 5.

Figure 30:
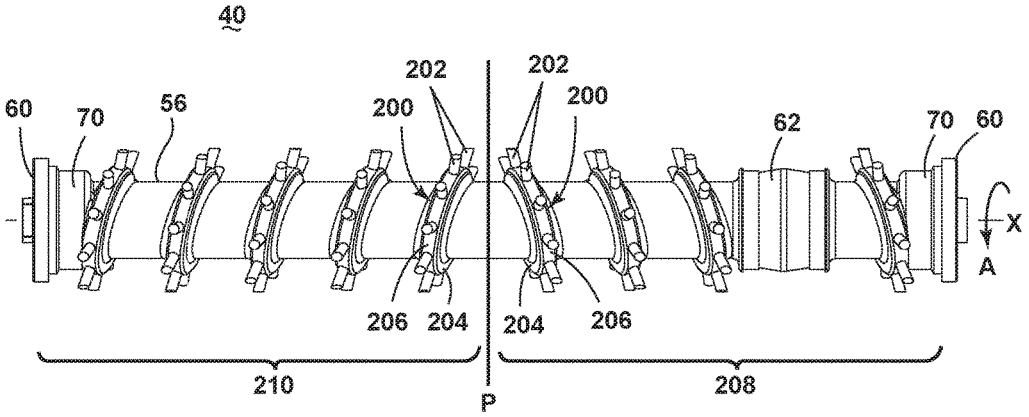
FIG. 30 is a perspective view of a brushroll according to a twelfth embodiment of the invention.

FIG. 30 is a perspective view of a brushroll 40 according to a twelfth embodiment of the invention, in which like elements are identified with the same reference numerals. The brushroll 40 can be used in place of the brushroll 40 on the vacuum cleaner 10 shown in FIGS. 1-2, and can be substantially similar to the brushroll 40 shown the first embodiment of FIG. 3, save for the agitation features provided on the dowel 56, as described below.

A plurality of bristle ridges 200 project or extend from the exterior surface of the brush dowel 56. A plurality of bristle tufts 202 can project or extend from each bristle ridge 200. Each bristle tuft 202 can include a plurality of flexible bristles, which may be made from a durable polymer material such as nylon or polyester, for example. Alternatively, instead of multiple discrete tufts 202 as shown herein, a continuous brush strip composed of a plurality of flexible bristles can be provided on each bristle ridge 200.

The bristle ridges 200 can be formed as discs 204 which extend around the circumference of the dowel 56, with each disc 204 having multiple bristle tufts 202 extending radially from an outer peripheral surface 206 of the disc 204. The tufts 202 of each disc 204 are spaced from each other such that the bristles of one tuft 202 do not intersect or touch the bristles from another tuft 202.

The bristle ridges 200 can be divided into two groups, a first group 208 associated with the pulley end of the dowel 56 and a second group 210 associated the opposing end of the dowel 56. With each group, the discs 204 can be oriented along parallel planes, but the discs 204 are all angled relative to a plane P perpendicular to the ends of the dowel 56. The discs 204 of the first group 208 can oriented at a positive acute angle relative to the plane P and the discs 204 of the second group 210 can oriented at a negative acute angle relative to the plane P. The leaning discs 204 effective oscillate the bristle tufts 202 back and forth as the brushroll 40 rotates. While not shown, radially aligned gaps can be formed in each disc 204 to effectively form a longitudinal slot across the length of the dowel 56 for the insertion of scissors for cutting hair that wraps around the dowel 56.

The brush dowel 56, including the bristle ridges 200, can be integrally molded, as described above, with the bristle tufts 202 assembled to the dowel 56 by pressing bristles into bristle holes (not shown) drilled into the molded dowel 56 and securing the bristles using a fastener (not shown), such as a staple 88 as in FIG. 5. The bristle tufts 202 can be tufted coplanar relative to the outer peripheral surface 206 of the disc 204. This allows the discs 204 to remain relatively thin since the drilled holes will not be too close to the sides of the disc 204 in this orientation.

Figure 31:
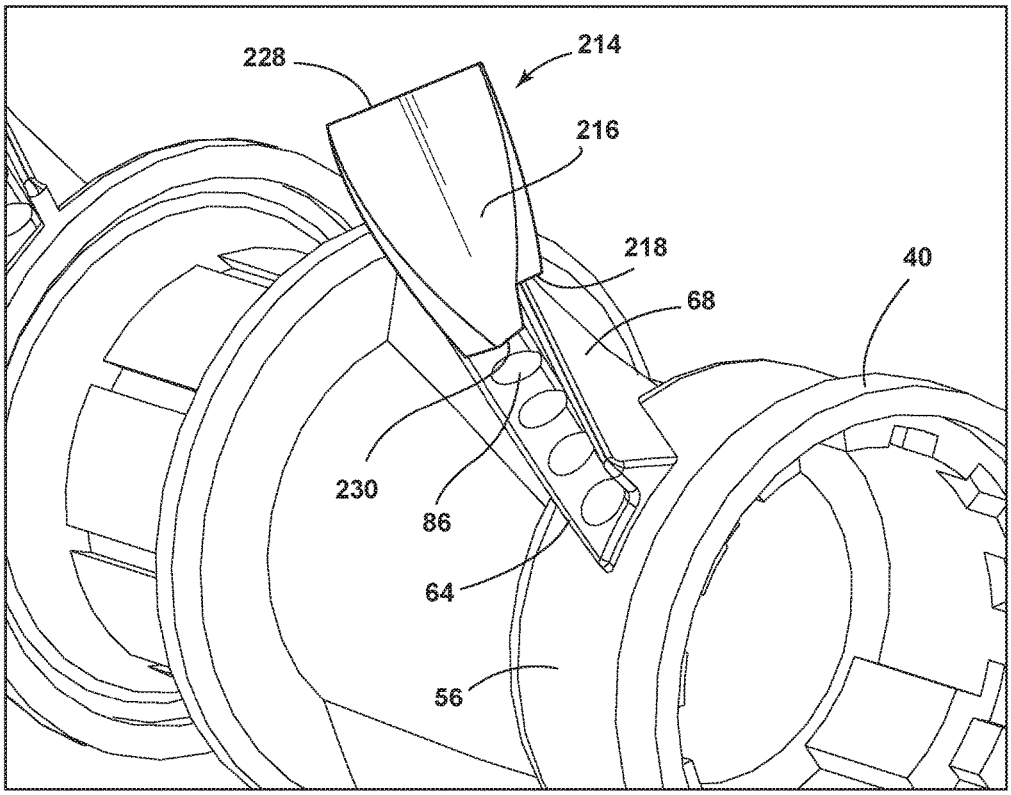
FIGS. 31 and 32 are schematic views of a bristle tufting tool according to a thirteenth embodiment of the invention.
Figure 32:
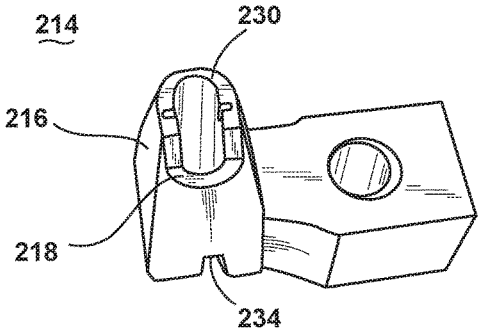

FIG. 31 is a schematic view of a bristle tufting tool 214 according to a thirteenth embodiment of the invention. The tufting process is illustrated on the brushroll 40 of the first embodiment, but may apply to tufting any type of brushroll having a bristle stiffener. As described above with respect to FIG. 5, the bristle stiffener 68 is adjacent to the bristle holes 86 for the bristle tufts (not shown), such that there is a small gap between the inner stiffener surface and the closest portion of the bristle tuft. During manufacturing, it is difficult to place the bristle tuft close to the bristle stiffener 68 because the bristles are guided by a sleeve during tufting. FIG. 31 shows a tufting tool 214 including a sleeve 216 with a notch 218 cut out of one side so that the sleeve 216 can clear the bristle stiffener 68. Along with the sleeve 216, the bristle stiffener 68 at the notch 218 can act as a guide to the tuft insertion on the stiffener side. This allows the bristle tuft to be located very close to the bristle stiffener 68. FIG. 32 is a bottom view of the tufting tool 216.

FIGS. 33-37 illustrate a method of tufting a brushroll dowel 56 using the tufting tool 214 of FIGS. 31-32. Using the tufting method, bristle tufts can be tufted close to a bristle stiffener on a brushroll dowel. In some versions, the tufting method may virtually eliminate any gap between the bristle tuft and the adjacent bristle stiffener 68 such that the bristle tuft is adjacent and in register with the stiffener 68. However, in other versions, a small gap may remain.

The method may be performed using a CNC tufting machine, a portion of which is schematically illustrated in the figures, that has a frame with a holding fixture that is configured to mount the dowel 56 and move the dowel 56 relative to the tufting tool 214 during operation. The tufting machine can comprise a supply of bristle material 220 and a supply of fasteners 88, such as staples, anchors, or wedges, for securing bristle tufts to the dowel 56. In addition to the tufting tool 214, the machine can further comprise a bristle cutting blade 222 and a bristle driving member 224, all of which can be adapted to reciprocate vertically relative to the dowel 56.

In one example, the holding fixture of the tufting machine can be configured to rotate the dowel 56 about its longitudinal axis and move the dowel 56 laterally along its longitudinal axis in accordance with output from a controller. While not shown herein, the tufting machine can comprise one or more sensors and controllers that output signals to various components on the machine according to a predetermined tufting program and desired tuft pattern. Furthermore, the tufting machine can comprise a bristle hole drilling station, or alternatively the bristle holes 86 can be pre-drilled in the dowel 56 on a separate machine.

Figure 33:
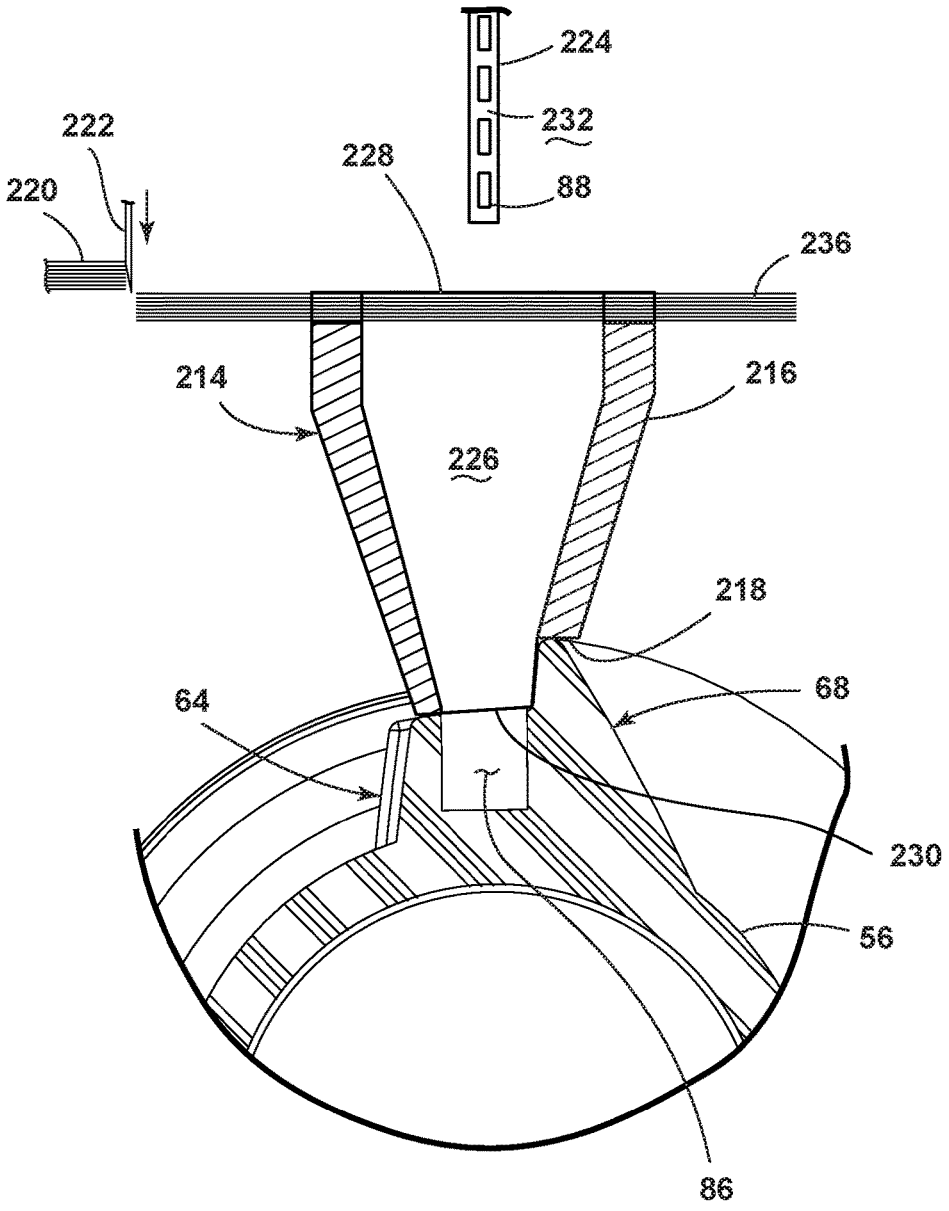
FIGS. 33-37 are schematic views illustrating the steps of a method of tufting a brushroll dowel using the tufting tool of FIGS. 31-32.

With reference to FIG. 33, the sleeve 216 of the tufting tool 214 includes a central bore 226 that tapers from a larger diameter at a top or inlet opening 228 of the sleeve 216 to a smaller diameter at a bottom or outlet opening 230 of the sleeve 216. The notch 218 is provided adjacent to the outlet opening 230. The bore 226 is configured to guide the driving member 224 and bristle bundles during the tufting operation.

The supply of bristle material 220 can be provided on a supply reel that can be connected to a controller and feeder mechanism configured to automatically feed a bundle of bristle filaments into the machine during operation. The cutting blade 222 can be associated with the feeder mechanism and configured to cut a bristle bundles to a predetermined length prior to insertion into the dowel 56.

The driving member 224 can comprise a rod-like member with a longitudinal slot 232 for delivering fasteners 88 to the bottom of the driving member where they are driven into the dowel. Alternatively, the fasteners 88 can be provided in a magazine or via a bulk hopper that is configured to selectively introduce a fastener 88 near the bottom of the sleeve 216 just prior to impact by the driving member 224.

In operation, a dowel 56 with a pre-formed bristle hole 86 can be loaded into the holding fixture and the tufting machine can be actuated. The holding fixture can automatically align the bristle hole 86 with the longitudinal axis of the tufting sleeve 216 by rotating and/or shifting the dowel 56 about its longitudinal axis according to output signals from the controller and sensor feedback.

To begin tufting, the tufting tool 214 descends downwardly and bottoms out on the dowel 56 with the bristle stiffener 68 nested within the notch 218 and the outlet opening 230 at least partially aligned with the bristle hole 86. The supply reel feeds bristle material 220 into the machine through an opening 234 (shown in FIG. 32) in the top of the tufting sleeve 216. The cutting blade 222 cuts a bristle bundle 236 to a predetermined length.

Figure 34:
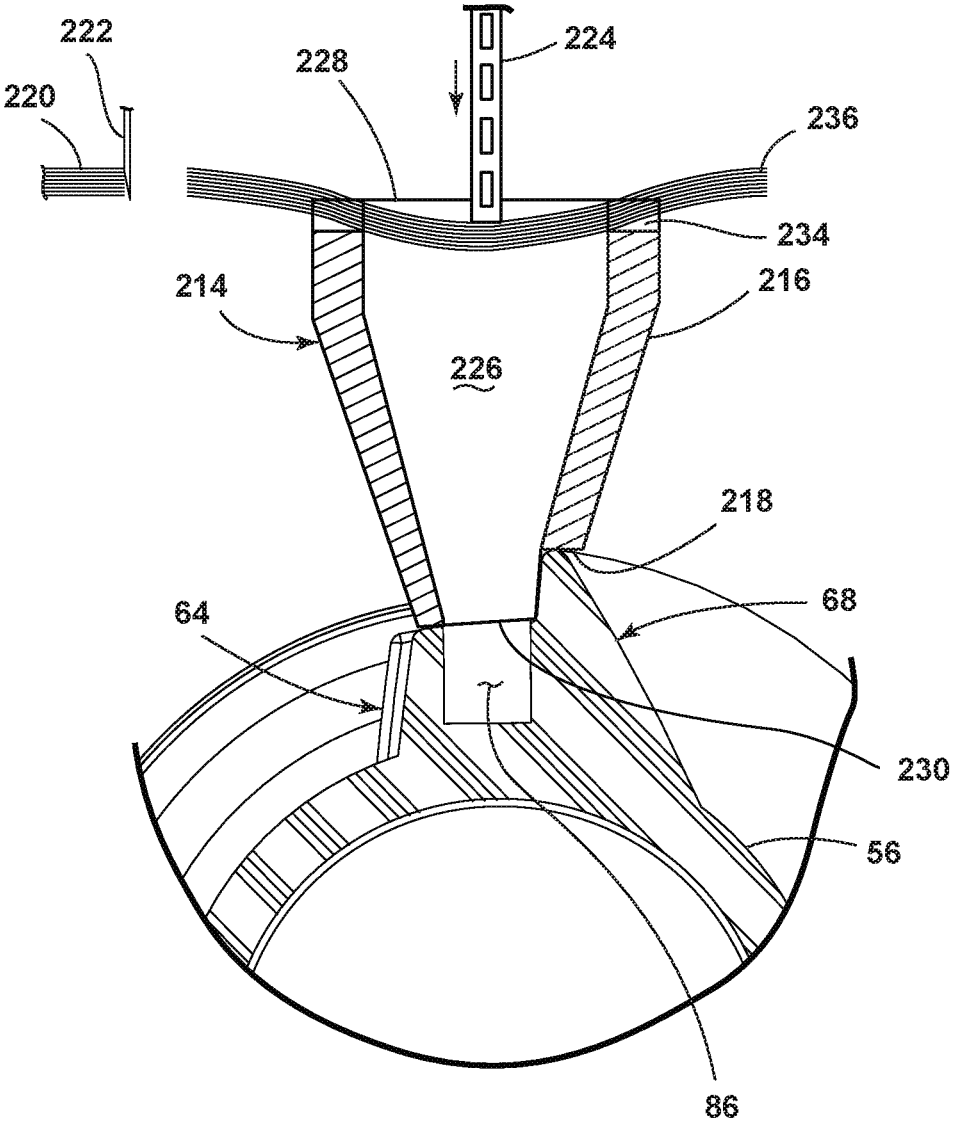

Referring to FIG. 34, the driving member 224 descends vertically within the tufting sleeve 216 and pushes the bristle bundle 236 through the bore 226 of the tufting sleeve 216.

Figure 35:
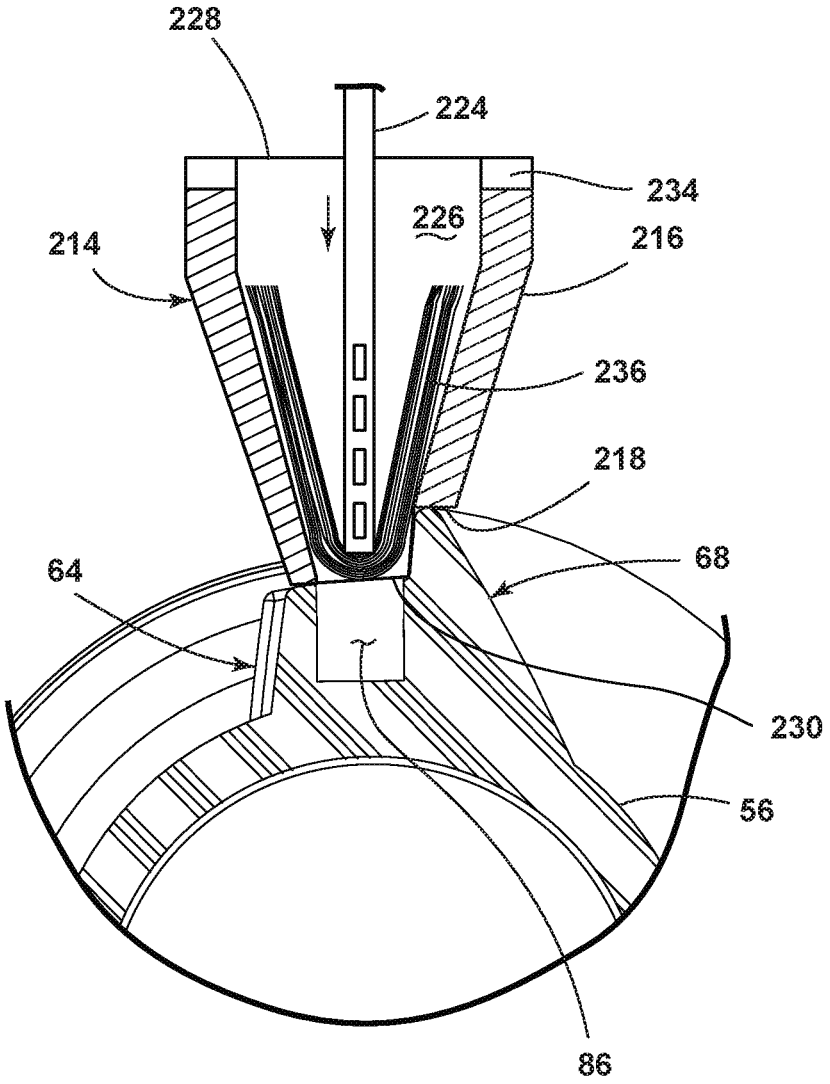

Referring to FIG. 35, as the bristle bundle 236 is pushed through the tufting sleeve 216, the bristle bundle 236 folds inwardly due to the tapered shape of the bore 226, such that the ends of the bristle bundle 236 converge towards the driving member 224 and the middle of the bristle bundle 236 is driven toward the bottom of the bristle hole 86.

Figure 36:
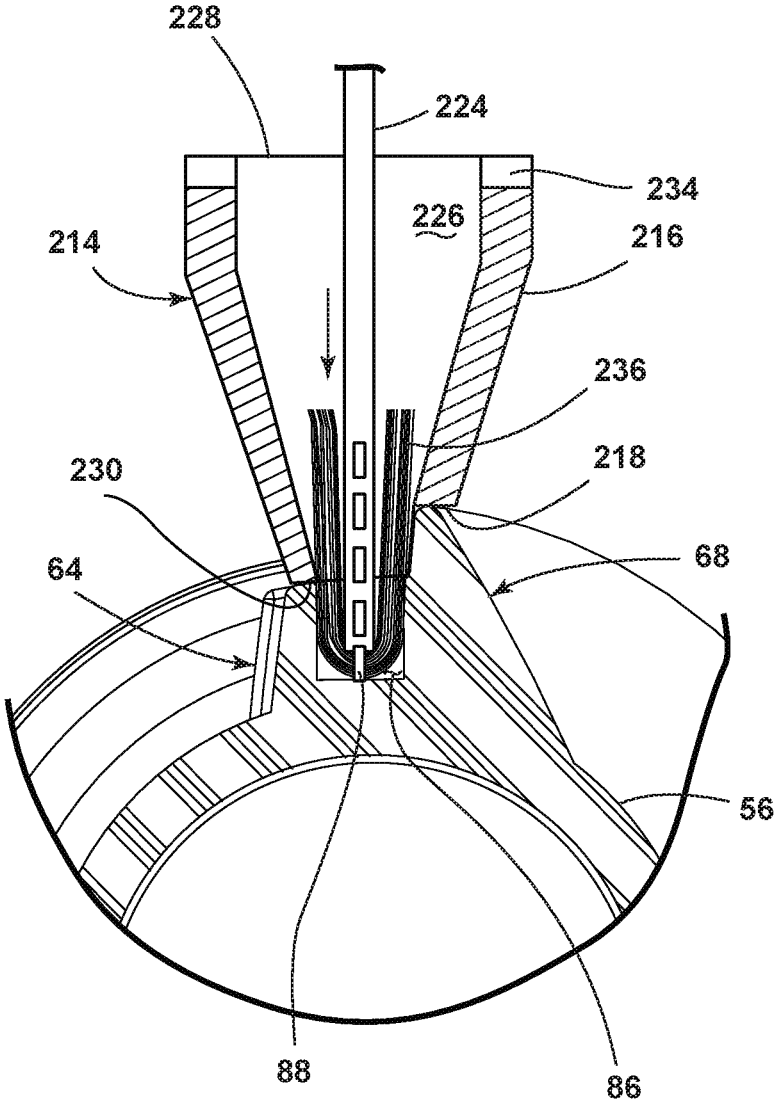

Referring to FIG. 36, as the bristle bundle 236 passes the notch 218, the portion of the bristle stiffener 68 aligned with the notch 218 at least partially guides the bristle bundle 236 out of the outlet opening 230 and into the bristle hole 86. Thus, the bristle bundle 236 is entirely surrounded by a combination of the sleeve 216 and a portion of the bristle stiffener 68 during insertion, with at least some of the bristles positioned in register with the bristle stiffener 68.

Figure 37:
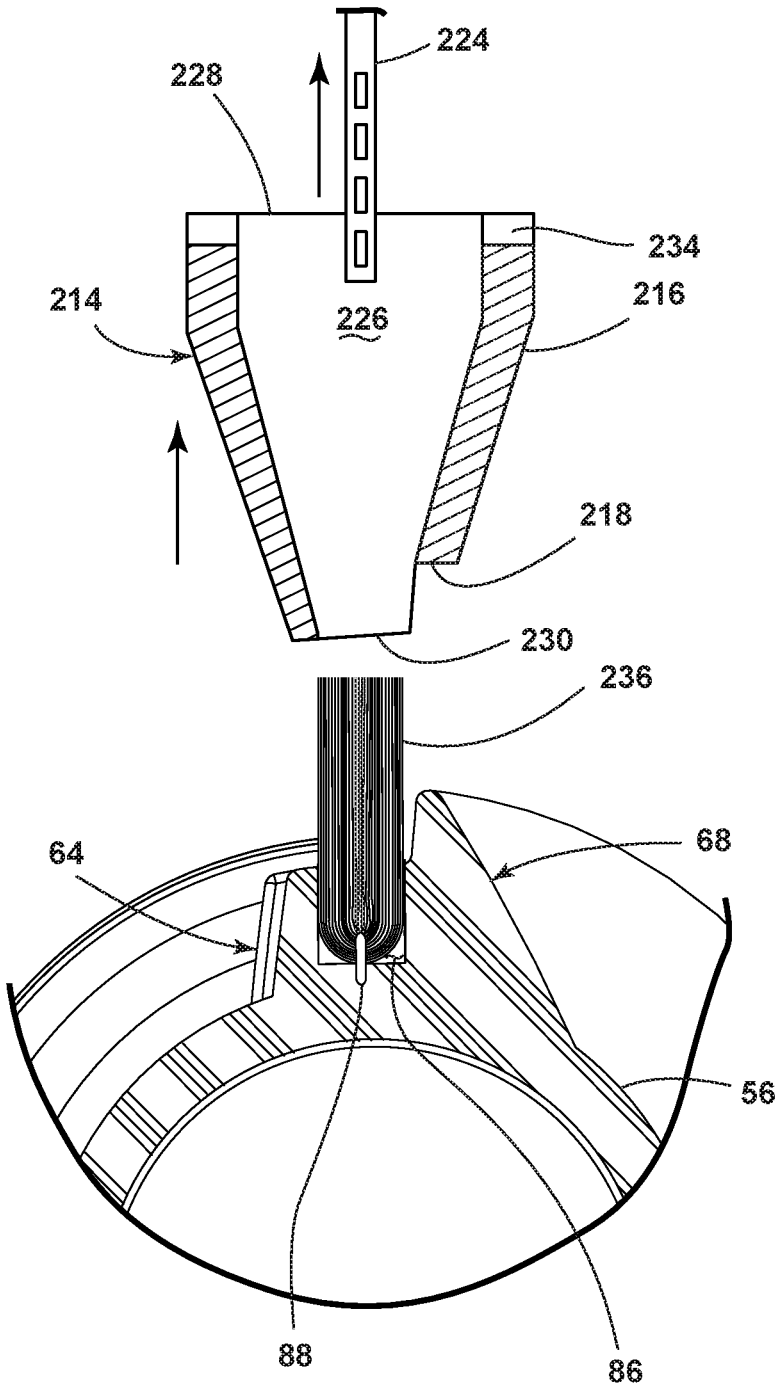

Referring to FIG. 37, once the bristle bundle 236 is fully pressed within the bristle hole 86, the driving member 224 inserts a fastener 88 at the bottom of the bristle hole 86 to retain the bristles deeply and securely within the bristle hole 86. The driving member 224 and tufting tool 214 can then be raised away from the dowel 56. It is noted that while the method is illustrated for a single tuft, brushrolls most commonly include multiple tufts of bristles; as such, it is understood that the method can be repeated multiple times in order to fully tuft the dowel 56. After the tufting operation is complete, additional operations can be commenced, such as a tuft trimming operation and a rotational balancing operation, for example.

The vacuum cleaner 10 and various brushrolls 40 disclosed herein provides improved cleaning performance and ease of manufacture. One advantage that may be realized in the practice of some embodiments of the described vacuum cleaner 10 and various brushrolls 40 is that the bristle stiffeners are formed as one-piece with the brushroll dowel in a two-piece or clamshell-type mold, with the bristle stiffeners drafted in the line of draw. This eliminates undercuts from the dowel, making it possible to integrally mold the bristle stiffeners with the dowel using a two-plate mold, which is much less complex and costly than other types of molds.

Another advantage that may be realized in the practice of some embodiments of the described tufting tool and associated tufting method is that bristle tufts can be tufted close to a bristle stiffener on a brushroll dowel so as to virtually eliminate any gap between the bristle tuft and the adjacent bristle stiffener.

While the invention has been specifically described in connection with certain specific embodiments thereof, it is to be understood that this is by way of illustration and not of limitation. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

What is claimed is:

1. A brushroll for a vacuum cleaner, comprising:

an injection-molded brush dowel having a central rotational axis defining an origin for a first axis extending through the dowel and a second axis extending through the dowel perpendicularly to the first axis to conceptually divide the dowel into quadrants;

two bristle stiffeners integrally molded with the dowel and lying in opposing quadrants, each having a parting line which is radially spaced from and non-parallel to the rotational axis; and a plurality of stiffened bristles protruding from the brush dowel adjacent to the bristle stiffeners;

wherein the first axis defines a line of draw for a two-piece mold forming the brush dowel and bristle stiffeners.

2. The brushroll of claim 1, wherein the dowel and bristle stiffeners are integrally molded without any undercuts on the dowel or bristle stiffeners.

3. The brushroll of claim 1 and further comprising a plurality of unstiffened bristles protruding from the brush dowel which are non-adjacent to the bristle stiffeners.

4. The brushroll of claim 3, wherein the stiffened and unstiffened bristles are each in tufts, and the diameter of the tufts of stiffened bristles is larger than the diameter of tufts of unstiffened bristles.

5. The brushroll of claim 3, wherein the stiffened bristles substantially lie along a centerline which passes through the rotational axis and the unstiffened bristles substantially lie along centerlines which are offset from the rotational axis.

6. The brushroll of claim 3, wherein the stiffened and unstiffened bristles substantially lie along centerlines which pass through the rotational axis.

7. The brushroll of claim 3, wherein the stiffened and unstiffened bristles substantially lie along centerlines which are offset from the rotational axis.

8. The brushroll of claim 3, wherein the stiffened bristles lie in the opposing quadrants and the unstiffened bristles lie in the other quadrants.

9. The brushroll of claim 3 and further comprising a plurality of bristle ridges projecting from the exterior surface of the dowel, wherein the stiffened and unstiffened bristles and bristle stiffeners extend from the bristle ridges.

10. The brushroll of claim 1, wherein the bristle stiffeners wrap helically around the dowel such that each parting line is helical with respect to the rotational axis.

11. The brushroll of claim 1, wherein the bristle stiffeners wrap angularly around the dowel such that each parting line is angular with respect to the rotational axis.

12. The brushroll of claim 1 and further comprising a plurality of bristle ridges projecting from the exterior surface of the dowel, wherein the stiffened bristles and bristle stiffeners extend from the bristle ridges.

13. The brushroll of claim 12, wherein at least one bristle ridge of the plurality of bristle ridges comprises a leading surface and a trailing surface, as defined in relation of the direction of rotation of the brush dowel about the central rotational axis, which project from the brush dowel and are joined by an outward surface.

14. The brushroll of claim 13, wherein at least one bristle stiffener comprises an inner stiffener surface which extends radially from the outward surface of the at least one bristle ridge to a stiffener edge which joins an upper end of the trailing surface of the at least one bristle ridge.

15. The brushroll of claim 14, wherein the stiffener edge is positioned radially inwardly of an end of the stiffened bristles protruding adjacent to the at least one bristle stiffener.

16. The brushroll of claim 14, wherein the trailing surface extends above the leading surface to form the at least one bristle stiffener.

17. The brushroll of claim 13 and further comprising a plurality of bristle holes in the outward surface of the at least one bristle ridge which extend at least partially into the at least one bristle ridge, wherein the stiffened bristles are received by the holes.

18. The brushroll of claim 1 and further comprising a shim between each bristle stiffener and the plurality of bristles.

19. The brushroll of claim 1, wherein the bristle stiffeners are positioned rearwardly of the stiffened bristles, as defined in relation of the direction of rotation of the brush dowel about the central rotational axis.

20. The brushroll of claim 1, wherein the first axis extends horizontally through the dowel and the second axis extends vertically through the dowel.

* * * * *